US008863421B1

(12) United States Patent
Farage

(10) Patent No.: US 8,863,421 B1
(45) Date of Patent: Oct. 21, 2014

(54) CASELESS AMMUNITION FIRING SYSTEM AND DEVICE

(76) Inventor: John Wadie Farage, Conyers, GA (US)

( * ) Notice: Subject to any disclaimer, the term of this patent is extended or adjusted under 35 U.S.C. 154(b) by 190 days.

(21) Appl. No.: 13/281,867

(22) Filed: Oct. 26, 2011

(51) Int. Cl.
*F41A 9/61* (2006.01)

(52) U.S. Cl.
USPC ..... 42/6; 42/84; 42/1.01; 89/135; 89/1.41; 89/26; 89/1.704; 102/431

(58) Field of Classification Search
USPC ..... 102/431; 89/1.41, 1.704, 1.706, 135; 42/6, 84
See application file for complete search history.

(56) References Cited

U.S. PATENT DOCUMENTS

| | | | | |
|---|---|---|---|---|
| 3,399,479 | A * | 9/1968 | Goldstein | 42/9 |
| 3,427,924 | A * | 2/1969 | Johnsen | 89/135 |
| 4,004,363 | A * | 1/1977 | Sackenreuter et al. | 42/9 |
| 2009/0277065 | A1 * | 11/2009 | Clark et al. | 42/1.03 |

* cited by examiner

*Primary Examiner* — Daniel J Troy
(74) *Attorney, Agent, or Firm* — Michael J. Bootcheck, LLC

(57) ABSTRACT

A firearm for firing caseless ammunition, the firearm comprising a stock which is capable of receiving one or more magazines of caseless ammunition, a frame connected to the stock, one or more barrels, each barrel having a respective central axis and each of the barrels being connected to the frame, one firing chamber for each barrel in communication with each respective barrel, and one or more blocking plates wherein the one or more blocking plates each perform at least two functions, (1) it prevents more than one round of ammunition from being loaded into each respective firing chamber, and (2) at least one surface of the blocking plate is a surface of the firing chamber and wherein the blocking plate is movable in a plane orthogonal to each of the barrel central axes.

12 Claims, 32 Drawing Sheets

56
58
60
68
80
82
84
86
92
94
96
100
101
102
103
104
105
106
107
111
113

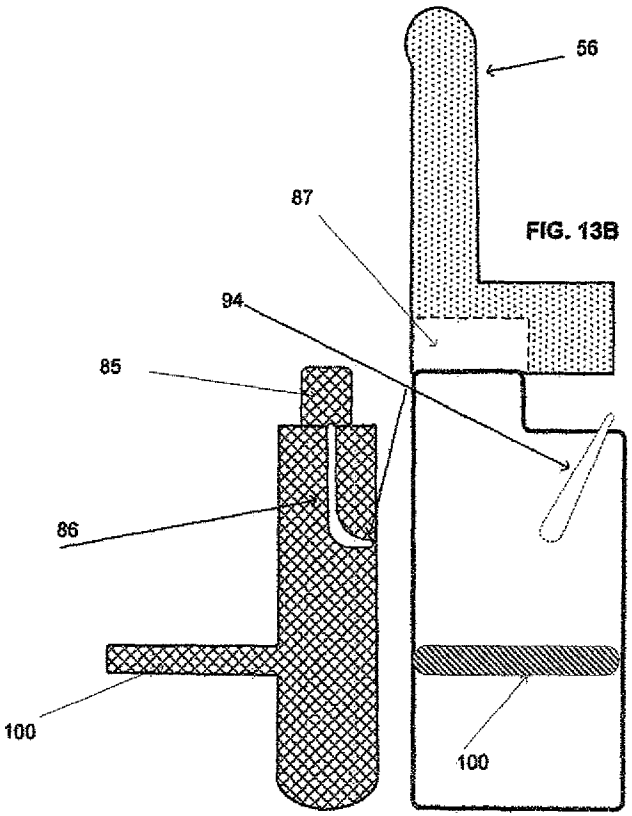
FIG. 13B
FIG. 13A
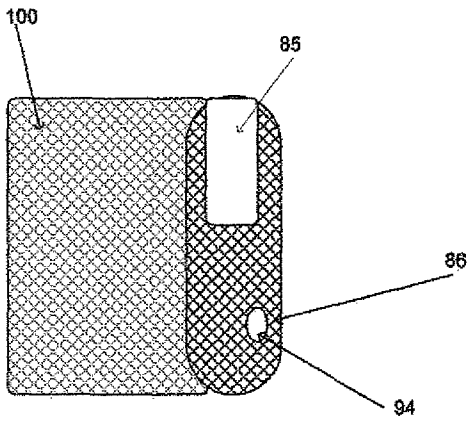
FIG. 12

56
84
90
92
88
60
94
86
100

106
113
84

107
92
94
50
58
107
111
96
104

103

102
101

101
103

105
82
104

82

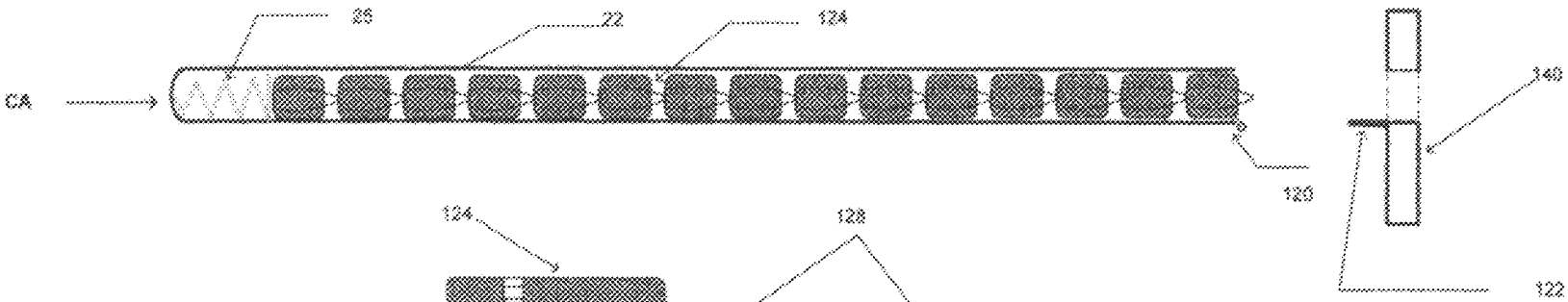
FIG. 28
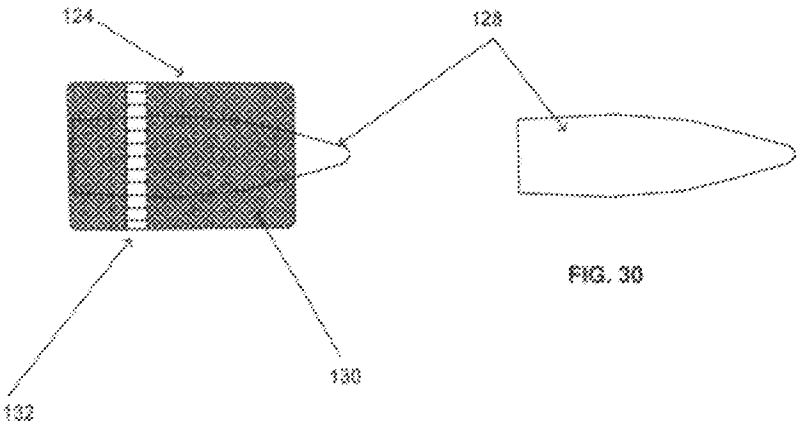
FIG. 29
FIG. 30

8B
56
90
92
84
96, 96'
94
86
50, 50'
68
60
100
101, 101'
102, 102'
103

105
82

95
94
92
107
96
100
102
103
50
93
111
58
118
104
96'
50'
102'
103'

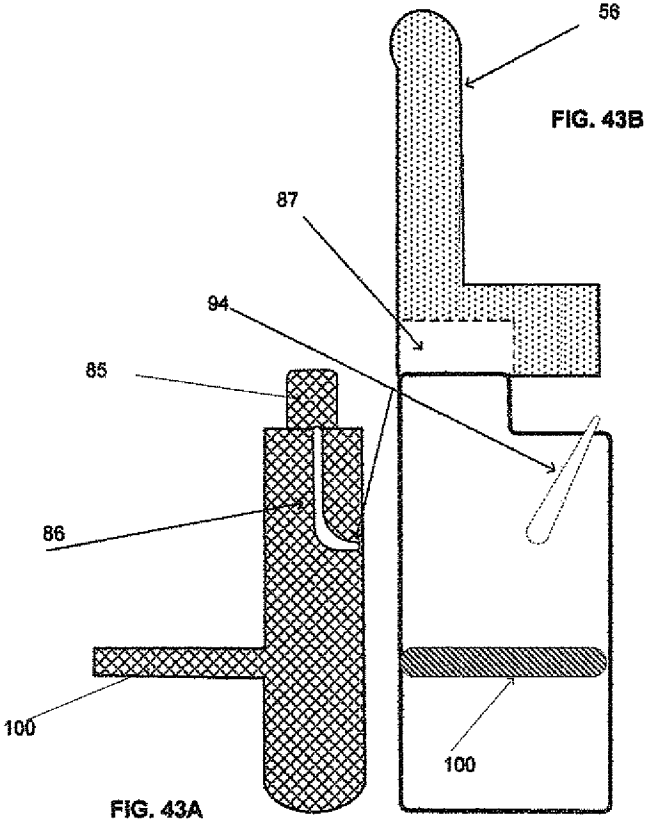
FIG. 43B
FIG. 43A
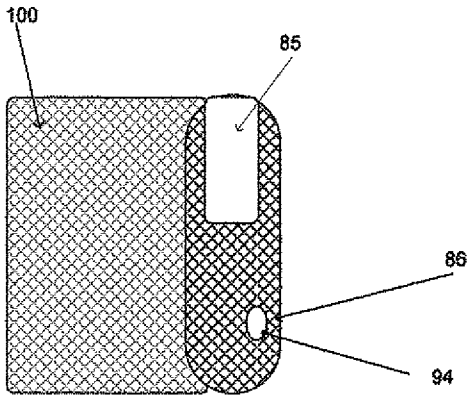
FIG. 42

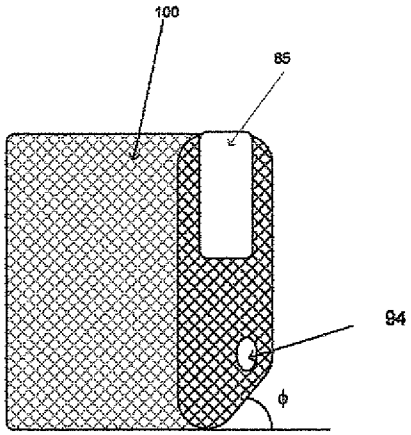
FIG. 44
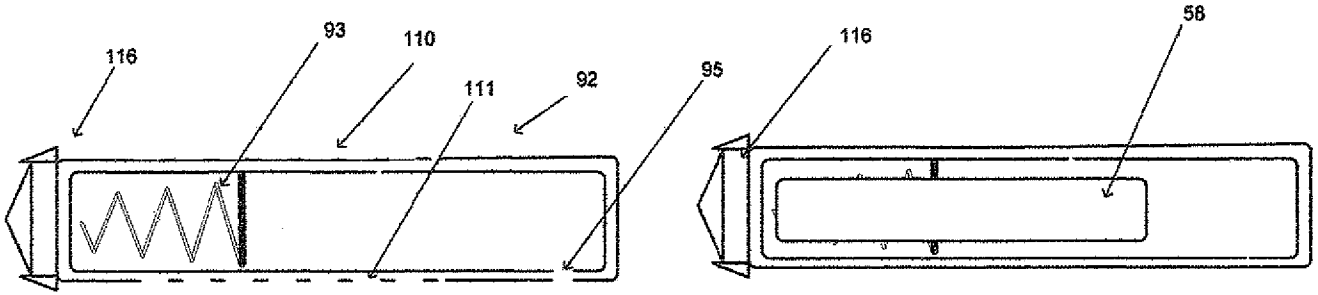
FIG. 45A
FIG. 45B 56
84
90
94
96
92
88
60
100

103, 103'

102, 102'

101, 101'
106
84
113

105
82
50
96
107
92
94
111
58
50'
107
96'
104

104

CASELESS AMMUNITION FIRING SYSTEM AND DEVICE

FIELD OF THE INVENTION

The present invention is directed to systems and devices for firing ammunition and more specifically to firearm systems and devices for firing caseless ammunition.

BACKGROUND OF THE INVENTION

The predominant method of ammunition manufacture for small arms today is based on metal casings that surround the explosive charge such that after a round is fired, the metal casing must be ejected from the firearm's firing chamber. This leads to several problems, (1) the cost of the metal casing is not insignificant and can be a large portion of the cost for the round, (2) the casing adds weight to the round and can be substantial if a lot of ammunition is being carried/transported, (3) upon being ejected from the firearm, the spent casing must be accommodated/stored, and (4) the extraction and ejection mechanism of the casings contribute to the recoiling of the firearm and, thus, reduce the accuracy of the fired round. These issues can be particularly troublesome if a large number of rounds are fired as the cost of materials is very high and the volume that the spent casings can take up can be considerable. These concerns are exacerbated in situations such as aircraft and armored vehicles where space is at a premium. What is needed is a weapon capable of automatic firing that can accommodate caseless ammunition rounds using electronic firing mechanisms.

SUMMARY OF THE INVENTION

The present invention is directed to a firearm which may consist of one or more barrels designed for rapid firing of caseless ammunition. In one embodiment, such a firearm may comprise a stock which is capable of receiving one or more magazines of caseless ammunition the magazine having a central axis, a frame connected to the stock, one or more barrels each barrel having a respective central axis and each of the barrels being connected to the frame, one firing chamber for each barrel in communication with respective barrel, and one or more blocking plates wherein the one or more blocking plates each perform at least two functions, (1) it prevents more than one round of ammunition from being loaded into each respective firing chamber, and (2) at least one surface of the blocking plate is a surface of the firing chamber and wherein the blocking plate is movable in a plane orthogonal to each of the barrel central axes.

According to another exemplary embodiment of the present invention, the invention comprises a stock which is capable of receiving one or more magazines of caseless ammunition the magazine having a central axis, one or more barrels each barrel having a respective central axis, one firing chamber for each barrel in communication with respective barrel, one or more blocking plates, and one or more stopper plates which prevent more than one round from entering the firing chamber.

In another exemplary embodiment of the present invention, the invention comprises a stock which is capable of receiving one or more magazines of caseless ammunition and each of the magazines is capable of holding two or more rounds, each of the rounds being aligned in the magazine to be co-axial about a central axis, a main frame connected to the stock, and one or more barrels each barrel having a respective central axis connected to the main frame, each of the barrels having one firing chamber in fluid communication with the respective barrel, one or more blocking plates which is movable and orthogonal to the axis, and a data acquisition system for tracking users, dates, and rounds fired.

BRIEF DESCRIPTION OF THE FIGURES

FIG. 12 illustrates a cross sectional top view of an exemplary blocking plate portion of an exemplary embodiment of the present invention;

FIGS. 13A-B illustrate side cross-sectional and frontal views of the exemplary blocking plate portion of FIG. 12;

FIG. 28 illustrates a cross-sectional view of an exemplary ammunition, exemplary magazine which may be suitable for use in an exemplary embodiment of the present invention as well as a magazine round stopper latch which may be a portion of a firearm such as that illustrated in various figures herein;

FIG. 29 illustrates an exemplary caseless ammunition round which may be used in various embodiments of the present invention;

FIG. 30 illustrates a bullet which may be used in various embodiments of the present invention;

FIG. 35 illustrates a cross-sectional top view of a receiver portion of an exemplary embodiment of the present invention;

FIG. 42 illustrates a cross sectional top view of an exemplary blocking plate portion of an exemplary embodiment of the present invention;

FIGS. 43A-B illustrate side cross-sectional and frontal views of the exemplary blocking plate portion of FIG. 42;

FIG. 44 illustrates a top view of another exemplary blocking plate portion of an exemplary embodiment of the present invention;

FIGS. 45A-B illustrate top cross-sectional views of an exemplary piston assembly portion of the present invention;

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Figure 1:
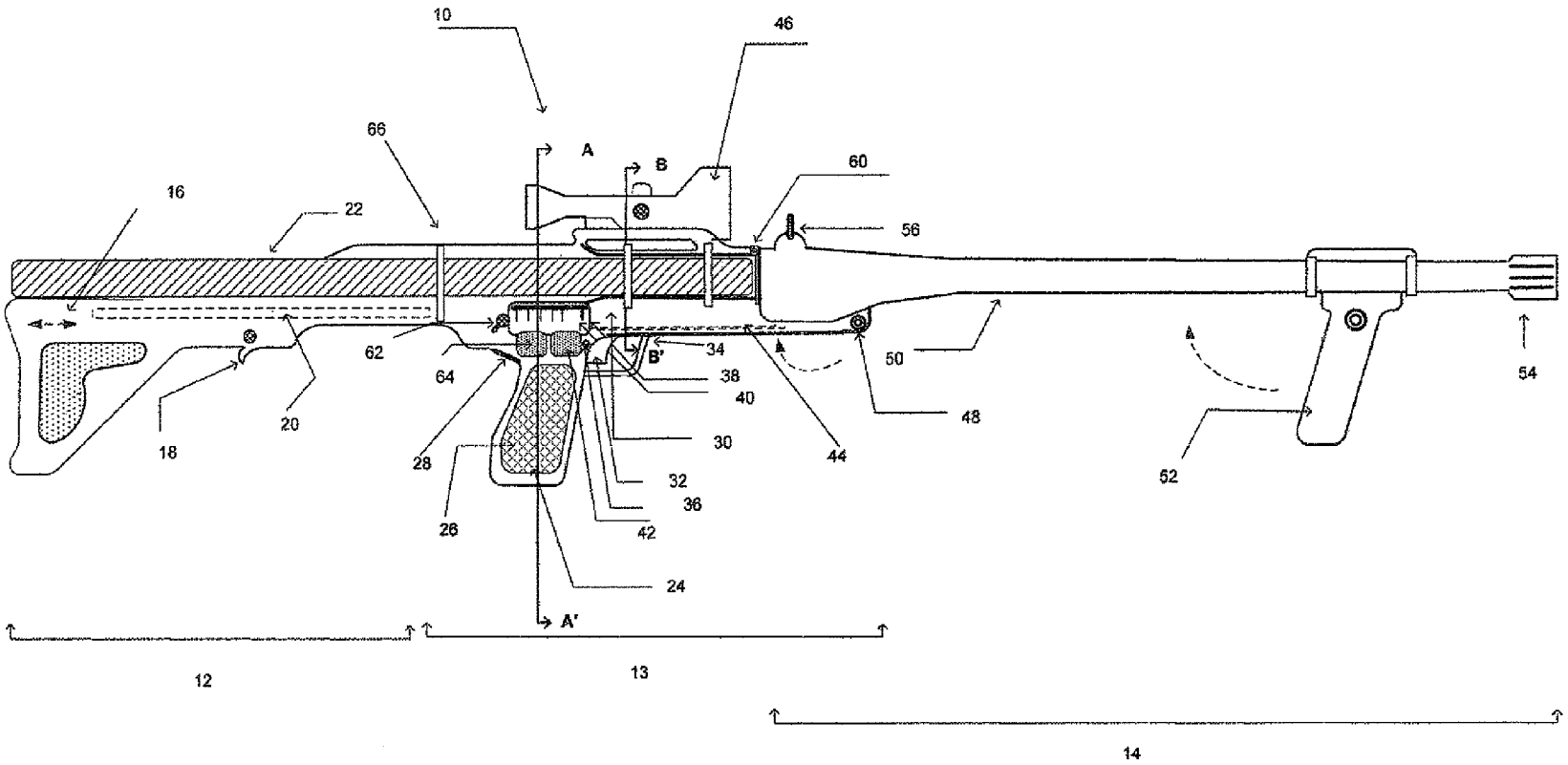
FIG. 1 illustrates a side cross-sectional view of a single barrel exemplary embodiment of the present invention.
Figure 26:
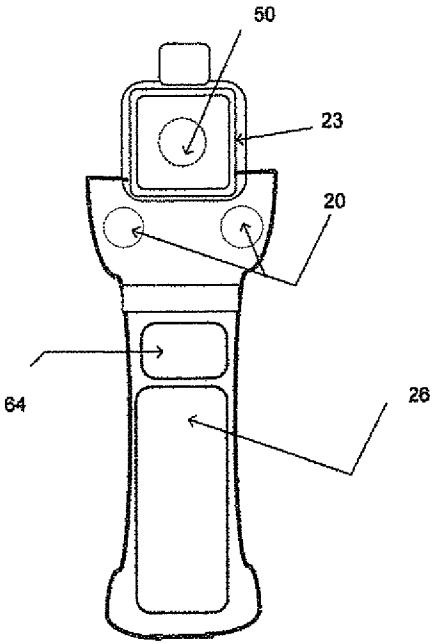
FIG. 26 illustrates a cross-sectional view along section line A-A' of FIG. 1.

FIG. 1 illustrates a side cross-sectional view of a single barrel exemplary embodiment firearm/weapon of the present invention. Illustrated is firearm/weapon 10, stock 12, frame 13, barrel portion 14, retractable butt stock 16, butt stock latch 18, butt stock rail 20, ammunition slot/tubing 22, grip 24, optional internal power source 26, optional USB port 28, electronic compartments 30, trigger 32, trigger guard 34, trigger lock 36, safety 38, firing mode selection switch 40, trigger electric switch 42, electric lines 44, scope 46, barrel pivot pin 48, barrel 50, handle/grip 52, muzzle suppressor 54, bolt slide lever 56, frame breaking pin release 60, electric activating switch 62, electronic microchip unit 64, and frame to rail holding rings 66. Also illustrated are section line A-A' (wherein this sectional view is illustrated in FIG. 26) and section line B-B' (illustrated in FIG. 27). In this exemplary embodiment, firearm 10 is oriented to accommodate a single magazine wherein the rounds in the magazine are positioned tip to end so that each bullet is pointing in the same direction about a common central axis CA (see FIG. 28).

Figure 2:
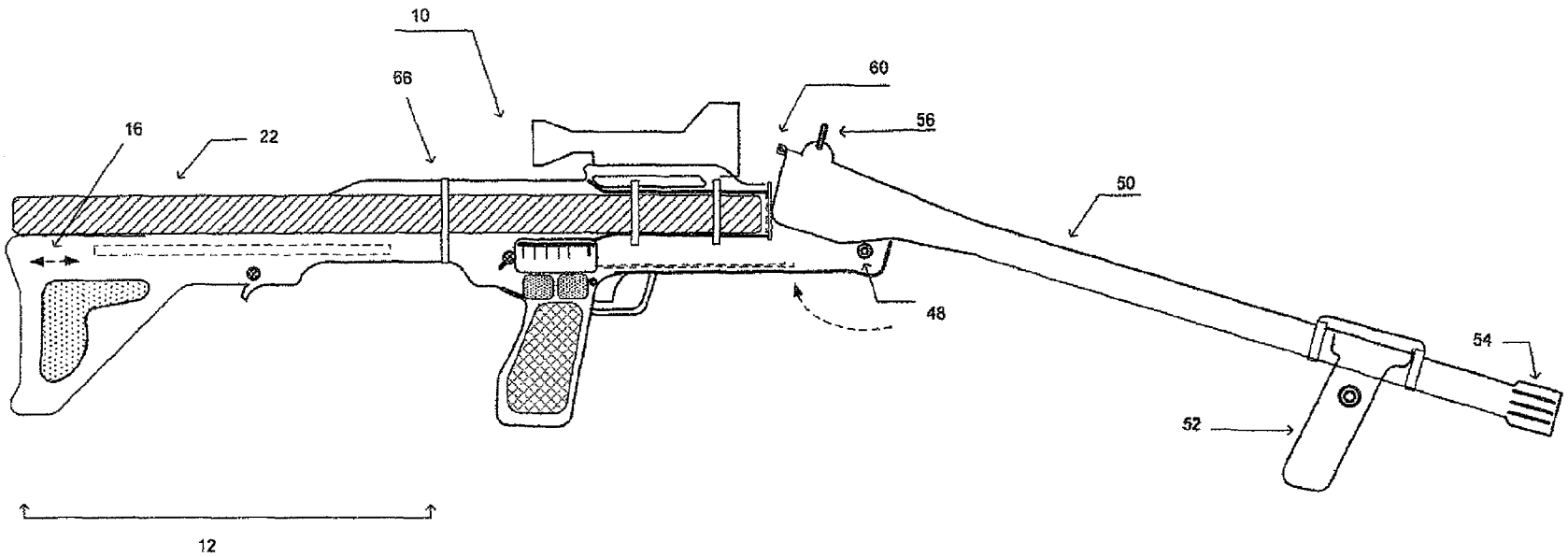
FIG. 2 illustrates a side cross-sectional view of the exemplary embodiment illustrated in FIG. 1 in a configuration to provide access to the firing chamber and barrel.

FIG. 2 illustrates a side view of the exemplary embodiment firearm 10 illustrated in FIG. 1 in a configuration to provide access to the firing chamber and barrel such that frame breaking pin release 60 has been released such that barrel 50 is pivoted with respect to frame 13 (and stock 12) such that the barrel and firing chamber 96 are accessible to a user for cleaning, loading, unloading and maintenance purposes. Also illustrated in this view are retractable butt stock 16, ammunition slot/tubing 22, barrel pivot pin 48, handle/grip 52, muzzle suppressor 54, bolt slide lever 56, and frame to rail holding rings.

Figure 3:
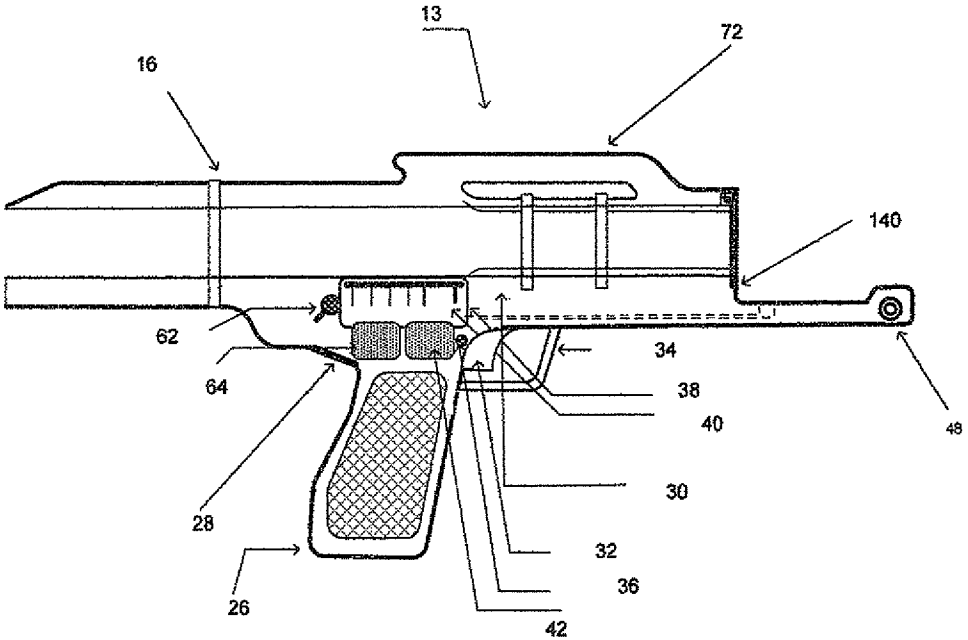
FIG. 3 illustrates a side cross-sectional side view of an exemplary main frame/receiver portion of the exemplary embodiment of FIGS. 1-2.

FIG. 3 illustrates a side cross-sectional side view of an exemplary main frame/receiver portion 13 of the exemplary embodiment of FIGS. 1-2. Illustrated is retractable butt stock 16, frame support plate 140, pivot pin 48, power source 26, optional USB port 28, electronic compartments 30, trigger 32, trigger guard 34, trigger lock 36, safety 38, firing mode selection switch 40, trigger electric switch 42, electric activating switch 62, electronic microchip unit 64, and scope mount railing 72.

Figure 4:
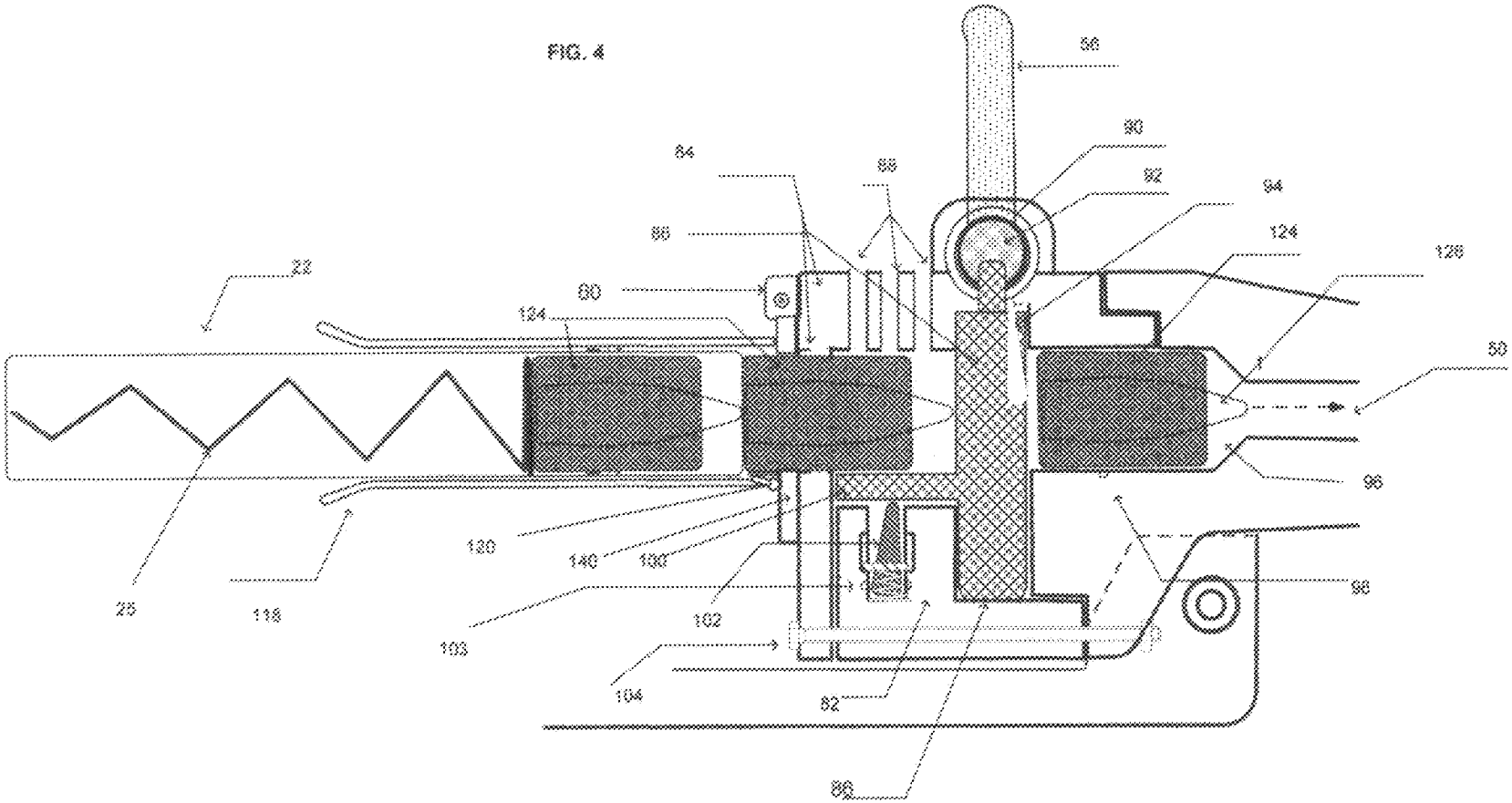
FIG. 4 illustrates a cross-sectional side view of a receiver portion of an exemplary embodiment of the present invention.

FIG. 4 illustrates a cross-sectional side view of a receiver portion of an exemplary embodiment of the present invention. Illustrated are ammunition slot/tubing/magazine 22, magazine loading spring 25, magazine feed ramp 118, frame breaking pin release 60, firing chamber lock/blocking plate 86, receiver casing 84 (may be removable), slots 88 (for ventilation), bolt slide lever 56, outer shell of gas piston 90, inner gas piston 92, gas escape slot/gap 94, firing chamber 96, barrel 50, bullet 128, caseless round/cartridge 124, magazine round stopper 120, cartridge stopper plate spring 103, cartridge stopper plate 102, blocking plate lip 100, frame support plate 140, receiver screws 104, receiver lower base 82, and firing electrode/electric pins 98 (may be multiple).

Figure 5:
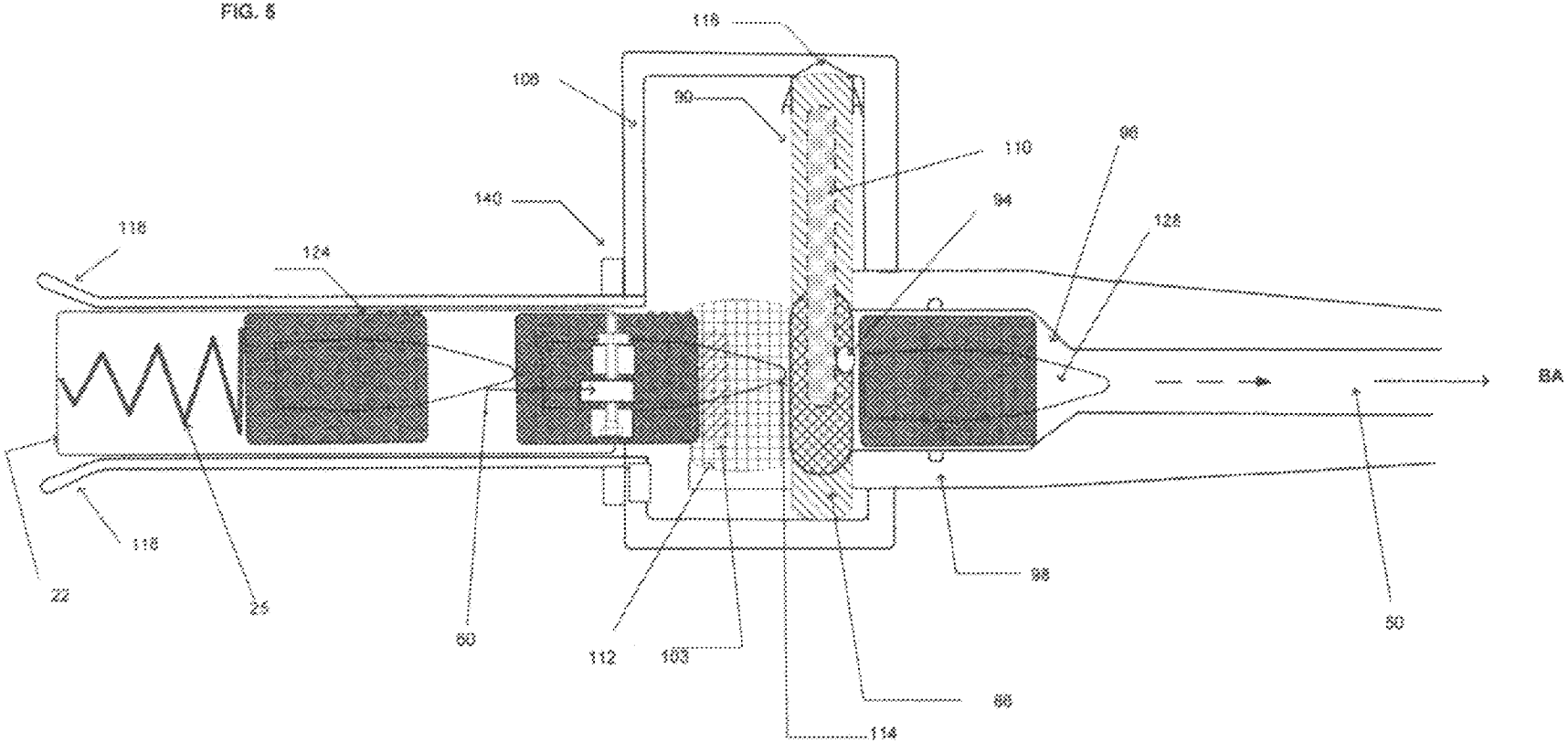
FIG. 5 illustrates a cross-sectional top view of a receiver portion of an exemplary embodiment of the present invention.

FIG. 5 illustrates a top cross-sectional view of an exemplary receiver portion of an exemplary embodiment of the present invention. Illustrated is magazine 22, magazine feed ramp 118, magazine loading spring 25, caseless round/cartridge 124, frame support plate 140, firing chamber side casing 106, outer shell of gas piston 90, gas piston service port 116, upper safety lever open slot 110, gas escape slot/gap 94, firing chamber 96, barrel 50, bullet 128, firing electrode/electric pins 98, firing chamber lock/blocking plate 86, tip of bullet 114, cartridge stopper plate spring 103, blocking plate lip 100, and frame breaking pin release 60.

Together, FIGS. 4 and 5 illustrate a relationship between a round in chamber 96 (round 1), a new round (round 2) which is on the other side of blocking plate 86 (thus being physically prevented from entering the firing chamber by the blocking plate), blocking plate 86, and cartridge stopper plate 102. When round 1 in the firing chamber is fired, part of the exhaust gas may be routed to a gas piston which may cause blocking plate 86 to move horizontally in this embodiment in a linear direction. Though blocking plate 86 is illustrated as moving linearly in a horizontal direction, it may also move in other directions such as vertically, or rotationally, in other embodiments. In some embodiments, the rotation may be in a plane that is orthogonal to a central axis of the respective barrel, whereas in other embodiments, the rotational movement of the blocking plate does not have to be constrained to only moving in such an orthogonal plane (with respect to a central axis of the respective barrel). Note that the motions of the blocking plate may be linear or nonlinear. Further, the motion of the blocking plate may also be a combination of rotational and translational or linear motion. In some embodiments, the blocking plate may be hinged so that it may be in at least two positions, (1) when the firing chamber is closed, and (2) when the blocking plate is in an "open" configuration and a round may be inserted into the firing chamber.

As blocking plate 86 moves out of the way of the firing chamber, round 2 is able to advance into the firing chamber. Note that cartridge stopper plate 102 does note prevent round 2 from entering the firing chamber because round 2 was already at least partially past the cartridge stopper plate. Continuing, as blocking plate 86 continues to move, and thus, blocking plate lip 100 also continues to move, eventually allowing cartridge stopper plate 102 the freedom to extend "upward" so that it prevents the following round, round 3, from accidentally entering the chamber. As the firearm is fired, this cycle repeats itself.

Figure 6B:
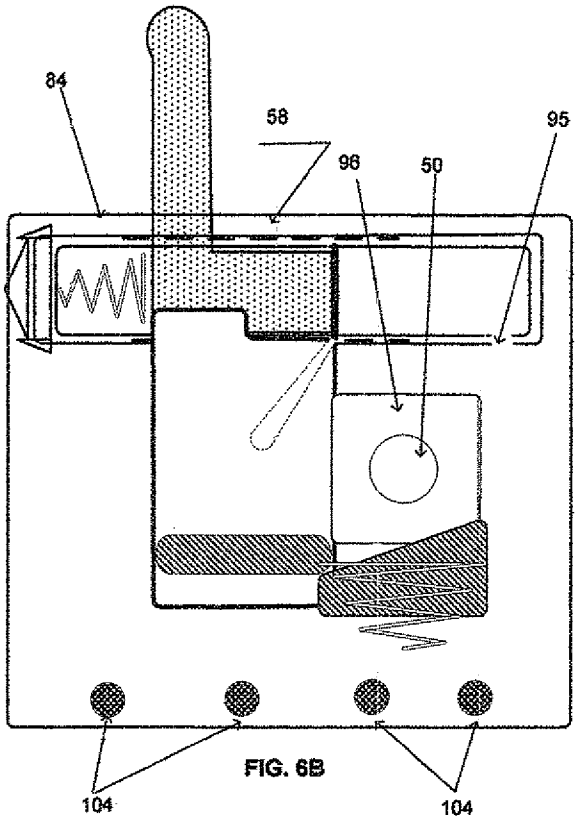
FIGS. 6A-D illustrate cross-sectional views of an exemplary receiver portion of an exemplary embodiment of the present invention at various stages of firing a round.
Figure 6A:
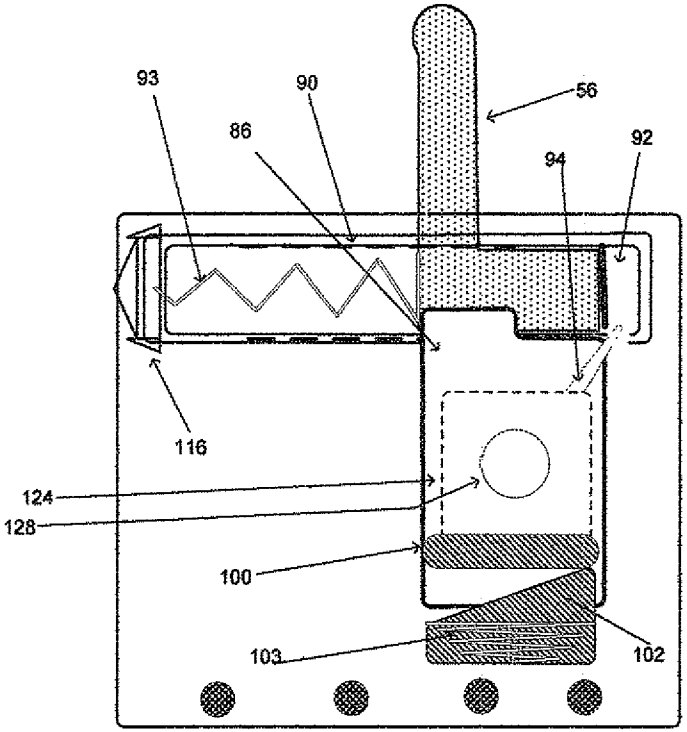

FIGS. 6A-D illustrate various stages for the positioning of blocking plate 86. FIG. 6A illustrates a stage wherein there is an unfired round in firing chamber 96. In this embodiment, bolt slide lever 56 is in contact with blocking plate 86 and, thus, blocking plate 86 is also biased to the "closed" condition illustrated. In this "closed" condition, blocking plate 86 seals off the end of the firing chamber nearest the butt of the gun (see FIG. 7B). Though this embodiment illustrates bolt slide lever 56 and blocking plate 86 as being two separate, though connected, components, they may also be constructed as a unitary piece. Also illustrated are outer shell of gas piston 90, inner gas piston 92, gas escape slot/gap 94, firing chamber 96, barrel 50, and gas piston service port 116.

In this configuration/condition, cartridge stopper plate 102 is biased in an "upward" position by cartridge stopper plate spring 103 (note that other biasing means may be used in lieu of compression springs including, but not limited to, tension springs, torsion springs, leaf springs, rubber, various elastomers, cushions, and pneumatics). In this stage/condition, an upper surface of cartridge stopper plate 102 may be in contact with a lower surface of blocking plate lip 100.

Upon firing of the round, some of the exhaust gas from the explosion may be routed through gas escape gap 94 such that some of the exhaust gas enters into inner gas piston 92. As this gas enters into this confined space, bolt slide lever 56 (and thereby blocking plate 86) is urged to move laterally (i.e., left in the illustration) against the force of gas piston spring 93 (note that other biasing means may be used in lieu of the illustrated compression spring). In some embodiments, the choice of the spring (or other biasing means) and the design parameters of the gas escape valve(s) and the piston will be appropriately tailored/specified/selected based on numerous factors including, but not limited to, the caliber/bullet to be fired, the geometry and configuration of the firing chamber, the rifling of the barrel, the length of the barrel, the load of the rounds, the shape of the bullet, the mass of the bullet, the gas gap open diameter and configuration.

FIG. 6B illustrates a transitional condition after the round has been fired and wherein bolt slide lever 56/blocking plate 86 are sliding laterally/orthoganally to the central axis BA of barrel 50 (although blocking plate 86 could also be pivoted so long as it can move out of the way such that rounds may be loaded into the firing chamber). As blocking plate 86 slides, cartridge stopper plate 102 may then move "upward" and the chamber is cleared. When blocking plate 86 has moved sufficiently that the chamber is open, a fresh round is loaded into firing chamber 96. After this first fresh round moves into the firing chamber, cartridge stopper plate 102 moves farther upward to prevent a second round from entering firing chamber 96. Barrel 50, gas link port 95, receiver casing 84, receiver screws/holes 104, and safety lever open slot in upper sleeve casing 58 are also illustrated in FIG. 6B. Then the firearm moves to the condition illustrated in FIG. 6C.

Figure 6D:
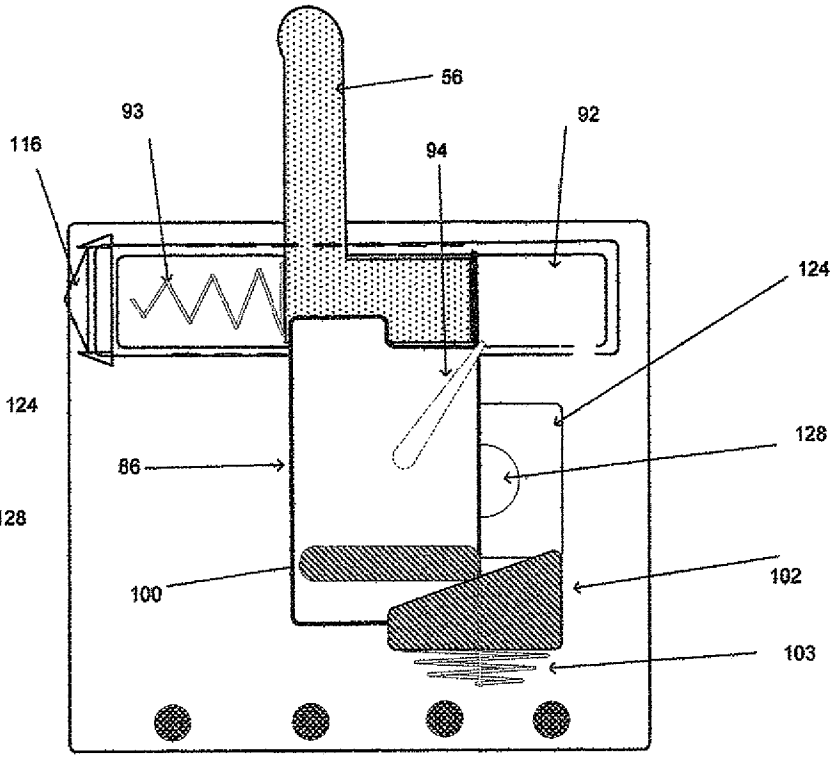
Figure 6C:
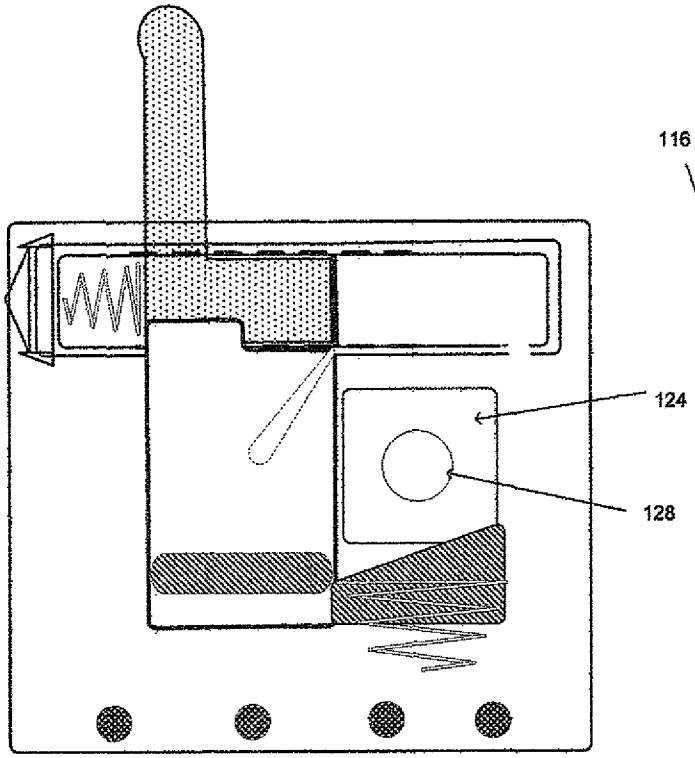

FIG. 6C illustrates a condition in which a new round has been placed into firing chamber 96. Thus, round 124 (and bullet 128) is visible in this illustration while it positioned in firing chamber 96. In this stage, blocking plate 86 is not yet in position to close firing chamber 96 but cartridge stopper plate 102 is positioned such that another round is prevented from entering firing chamber 96.

FIG. 6D illustrates a condition in which blocking plate 86 is moving to close firing chamber 96 so that the round may be fired. The next stage would be that as illustrated in FIG. 6A.

Note that various methods may be used to place an initial round into firing chamber 96. In order to load a round into the firing chamber, a user may manually cock the receiver (such as by sliding bolt slide lever 56) once to allow a round to enter the barrel into the firing chamber as magazine 22 may be biased such as illustrated in the embodiment of FIG. 5. Alternatively, the user may open the firearm (as illustrated in FIG. 2) to directly access firing chamber 96 to manually place a round into the firing chamber, or, in other embodiments, the loading of the firing chamber may be automated. Once the round is in the chamber we are in the position illustrated in FIG. 6A.

Figures 7A, 7B, 8, 9A, 9B, 10A, 10B, 11:
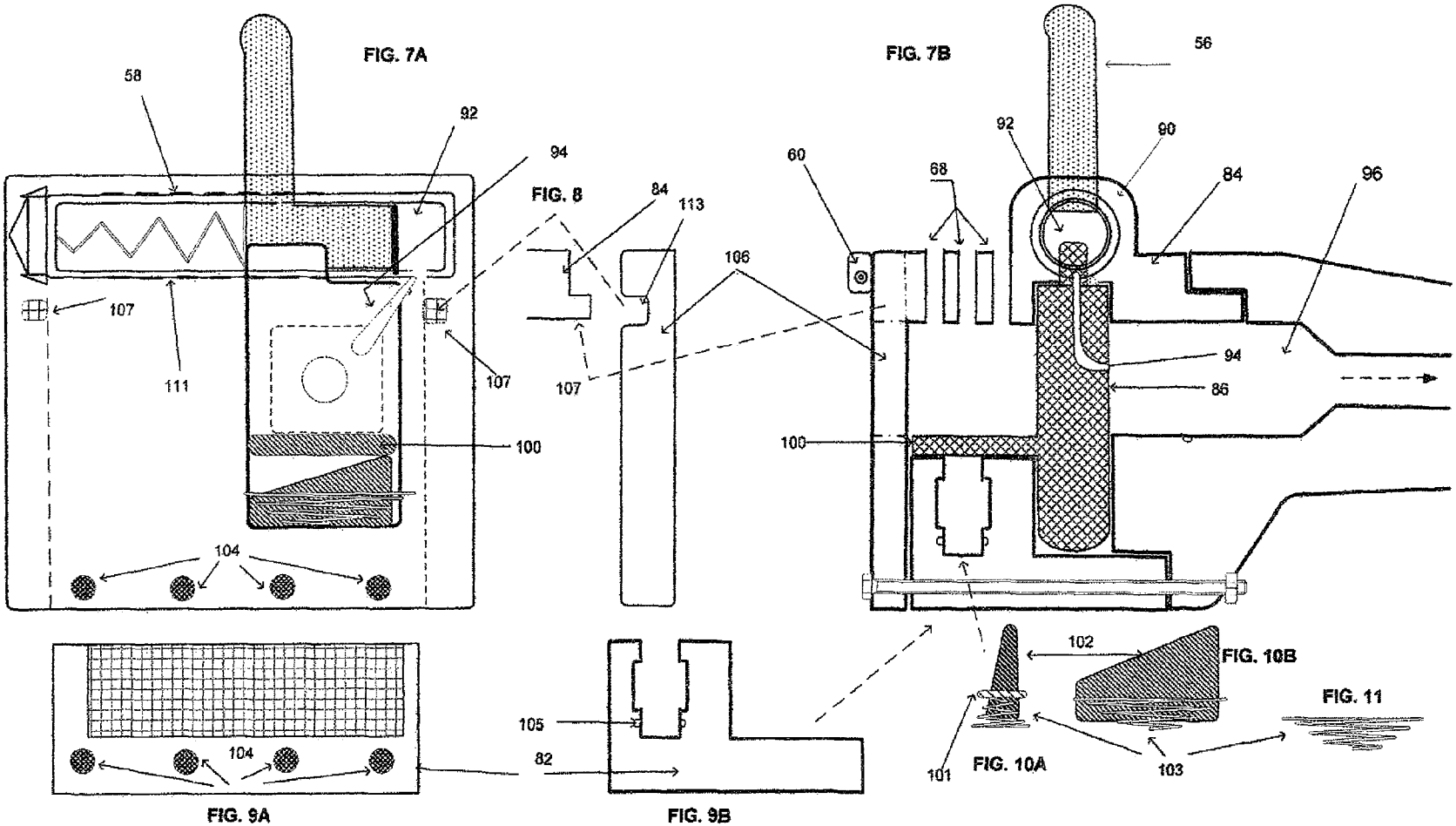
FIGS. 7A-B illustrate cross-sectional end and side views of a receiver portion of an exemplary embodiment of the present invention.
FIG. 8 illustrates a relationship between various members of an exemplary embodiment of the present invention.
FIGS. 9A-B illustrate a receiver lower base portion of an exemplary embodiment of the present invention in frontal and side views, respectively.
FIGS. 10A-B illustrate a cartridge stopper plate and cartridge stopper plate spring portion of an exemplary embodiment of the present invention in side and frontal views, respectively.
FIG. 11 illustrates an exemplary cartridge stopper plate spring portion of an exemplary embodiment of the present invention.

FIGS. 7A-B illustrate cross-sectional end and side views, respectively, of a receiver portion of an exemplary embodiment of the present invention. Illustrated are safety lever open slot in upper sleeve casing 58, casing slide notch 107, lower safety lever open slot 111, blocking plate lip 100, receiver screws/holes 104, gas escape 94, and inner gas piston 92.

FIG. 7B illustrates an arrangement for an exemplary receiver portion showing bolt slide lever 56, outer shell of gas piston 90, upper receiver casing 84, firing chamber 96, gas escape gap 94, blocking plate 86, blocking plate lip 100, firing chamber side casing 106, frame breaking pin release 60, upper ventilation slots 68, and inner gas piston 92.

FIG. 8 illustrates a relationship between various members of an exemplary embodiment of the present invention. Slot 113 of firing chamber side casing 106 is shaped to accommodate and mate with casing slide notch 107 to fix the relationship between the various members.

FIGS. 9A-B illustrate a receiver lower base portion 82 of an exemplary embodiment of the present invention in frontal and side views, respectively. Also illustrated are various receiver screws/holes 104 (i.e., a number of holes through which bolts or screws maybe inserted in order to connect two or members together in a fixed, but removable, relationship), spring anchor 105 which limits the ability of cartridge stopper plate 102 to move, and a channel in which cartridge stopper plate 102 may move.

FIGS. 10A-B illustrate cartridge stopper plate 102 and cartridge stopper plate spring 103 of an exemplary embodiment of the present invention in side and frontal views, respectively. Also illustrated is stopper plate spring fastener 101 which allows the spring/biasing means to be attached to the cartridge stopper plate. In some embodiments, the stopper plate spring fastener and cartridge stopper plate may be unitary. In some embodiments, the cartridge stopper plate, stopper plate spring fastener and biasing means (such as a cartridge stopper plate spring) may be unitarily constructed.

FIG. 11 illustrates an exemplary cartridge stopper plate spring 103 of an exemplary embodiment of the present invention.

FIG. 12 illustrates a cross sectional top view of an exemplary blocking plate 86 of an exemplary embodiment of the present invention. Illustrated is an arrangement for blocking plate 86 with blocking plate lip 100, lock plate bolt 85, and gas escape gap 94.

FIGS. 13A-B illustrate cross-sectional side and frontal views, respectively, of the exemplary blocking plate portion of FIG. 12 showing bolt slide lever 56, blocking plate 86, gas escape gap 94, blocking plate lip 100, lock plate bolt 85, and lock plate bolt socket 87. Note that FIG. 13B is an exploded view and that when fully installed, lock plate bolt 85 may be received into lock plate bolt socket 87.

Figure 14:
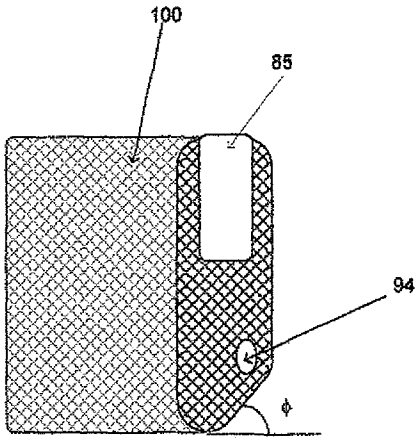
FIG. 14 illustrates a top view of another exemplary blocking plate portion of an exemplary embodiment of the present invention.

FIG. 14 illustrates a top view of another exemplary blocking plate 86 of an exemplary embodiment of the present invention. In this embodiment, there is a cutaway/angled portion Φ. In some embodiments, it may be advantage to have such an angled portion in order to push a partially inserted round fully into the firing chamber. Illustrated is an arrangement for blocking plate 86, blocking plate lip 100, lock plate bolt 85, and gas escape gap 94.

Figure 15B:
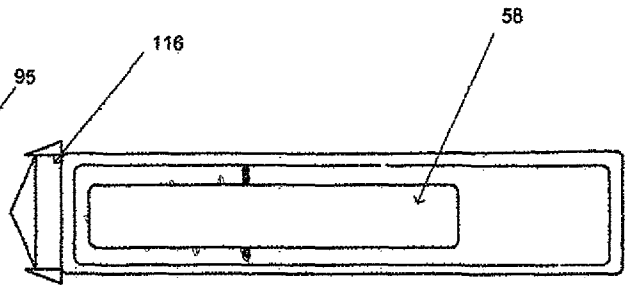
FIGS. 15A-B illustrate top cross-sectional views of an exemplary piston assembly portion of the present invention.
Figure 15A:
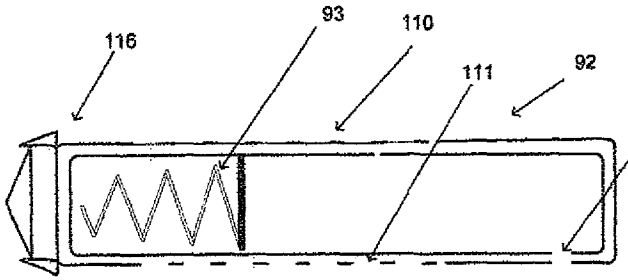

FIGS. 15A-B illustrate top cross-sectional side and top views, respectively, views of an exemplary piston assembly portion of the present invention. Illustrated in FIG. 15A is an exemplary embodiment relationship of gas piston service port 116, gas piston spring 93, upper safety lever open slot 110, lower safety lever open slot 111, inner gas piston 92, and gas link port 95.

FIG. 15B illustrates a top view of a safety lever open slot in upper sleeve casing 58, and gas piston service port 116.

Figures 16A, 16B, 17, 18A, 18B, 19A, 19B, 20:
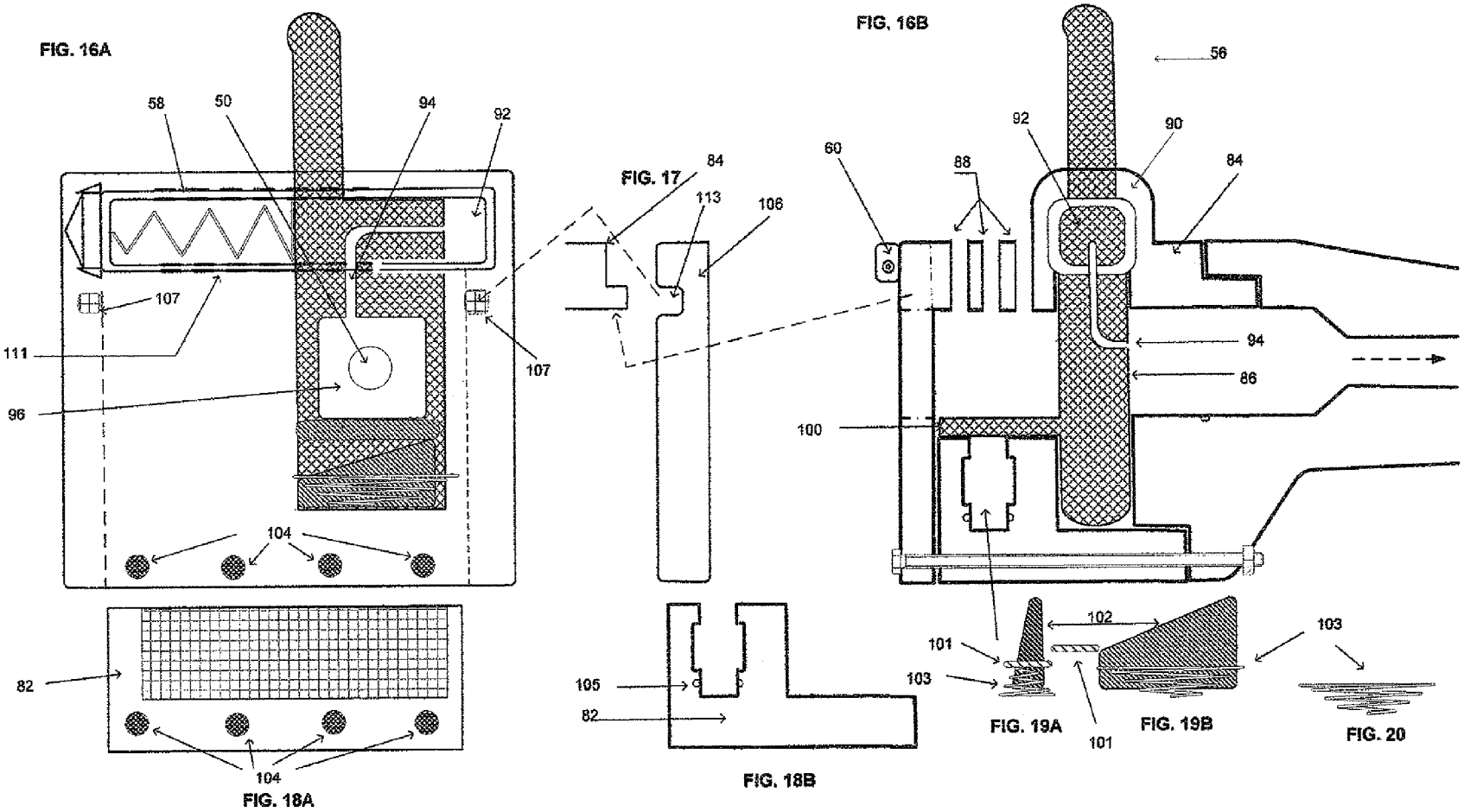
FIGS. 16A-B illustrate cross-sectional end and side views of a receiver portion of another exemplary embodiment of the present invention.
FIG. 17 illustrates a relationship between various members of an exemplary embodiment of the present invention.
FIGS. 18A-B illustrate a receiver lower base portion of another exemplary embodiment of the present invention in frontal and side views, respectively.
FIGS. 19A-B illustrate a cartridge stopper plate and cartridge stopper plate spring portion of an exemplary embodiment of the present invention in side and frontal views, respectively.
FIG. 20 illustrates an exemplary cartridge stopper plate spring portion of an exemplary embodiment of the present invention.

FIGS. 16A-B illustrate cross-sectional end and side views, respectively, of a receiver portion of another exemplary embodiment of the present invention. Illustrated are safety lever open slot in upper sleeve casing 58, casing slide notch 107, lower safety lever open slot 111, blocking plate lip 100, receiver screws/holes 104, gas escape 94, and inner gas piston 92. In this exemplary embodiment, gas escape 94 takes an alternate route for exhaust gas to enter inner gas piston 92.

FIG. 16B illustrates a side view of the exemplary receiver portion of FIG. 16A showing bolt slide lever 56, outer shell of gas piston 90, upper receiver casing 84, firing chamber 96, gas escape gap 94, blocking plate 86, blocking plate lip 100, firing chamber side casing 106, frame breaking pin release 60, upper ventilation slots 68, and inner gas piston 92.

FIG. 17 illustrates a relationship between various members of an exemplary embodiment of the present invention.

FIGS. 18A-B illustrate a receiver lower base portion of another exemplary embodiment of the present invention in frontal and side views, respectively. Illustrated is a receiver lower base portion 82 of an exemplary embodiment of the present invention in frontal and side views, respectively. Also illustrated are various receiver screws/holes 104 (i.e., a number of holes through which bolts or screws maybe inserted in order to connect two or members together in a fixed, but removable, relationship), spring anchor 105 which limits the ability of cartridge stopper plate 102 to move, and a channel in which cartridge stopper plate 102 may move.

FIGS. 19A-B illustrate cartridge stopper plate 102 and cartridge stopper plate spring 103 of an exemplary embodiment of the present invention in side and frontal views, respectively. Also illustrated is stopper plate spring fastener 101.

FIG. 20 illustrates an exemplary cartridge stopper plate spring 103 of an exemplary embodiment of the present invention.

Figure 21B:
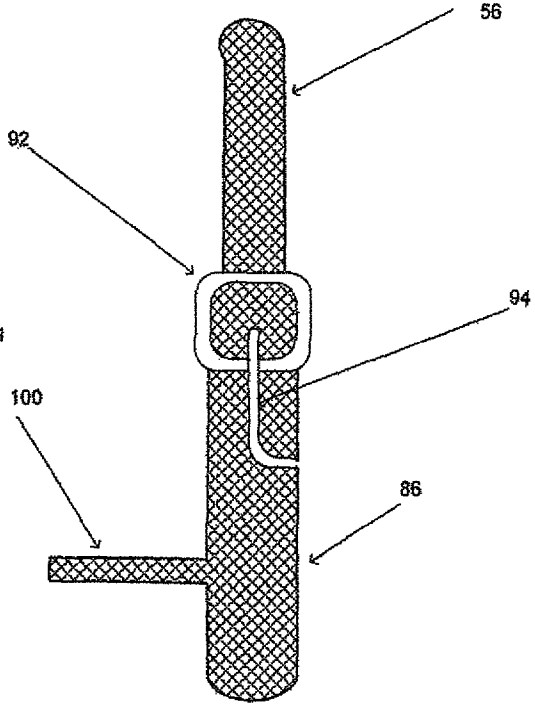
FIGS. 21A-B illustrate frontal and side cross-sectional views of another exemplary blocking plate portion of the present invention.
Figure 21A:
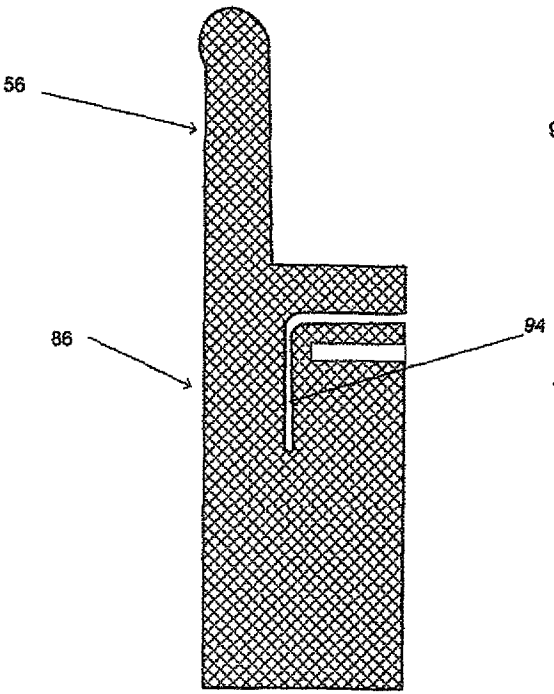

FIGS. 21 A-B illustrate cross-sectional frontal and side views, respectively, of the exemplary blocking plate 86 and bolt slide lever portion of FIGS. 16A-B in which they may comprise a single component. Illustrated is an arrangement showing bolt slide lever 56, blocking plate 86, inner gas piston 92, gas escape gap 94, blocking plate lip 100, and lock plate bolt 85.

Figure 22:
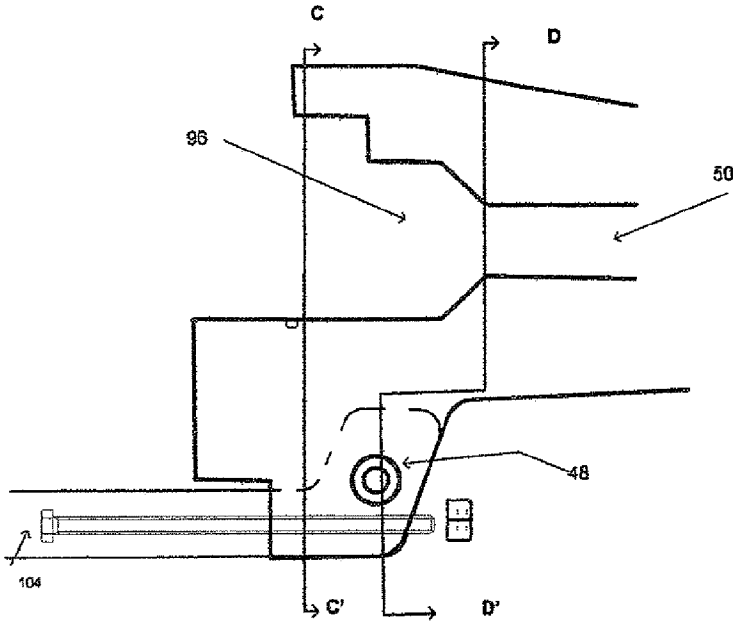
FIG. 22 illustrates a cross-sectional view of a receiver and barrel portion of an exemplary embodiment of the present invention.

FIG. 22 illustrates a cross-sectional view of an exemplary receiver and barrel portion of an exemplary embodiment of the present invention illustrating a portion of firing chamber 96, barrel 50, pivot pin 48, and receiver screws/holes 104. Also illustrated are section lines C-C', and D-D' as further illustrated in FIGS. 23-24.

Figure 23:
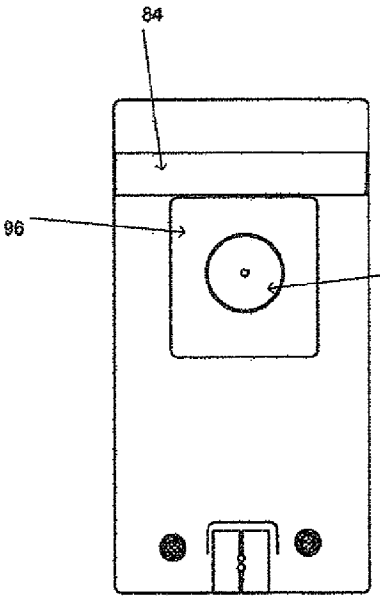
FIG. 23 illustrates a cross-sectional view along section line C-C' of FIG. 22.

FIG. 23 illustrates a cross-sectional view along section line C-C' of FIG. 22. An arrangement of upper receiver casing 84, firing chamber 96, and barrel 50 is illustrated.

Figure 24:
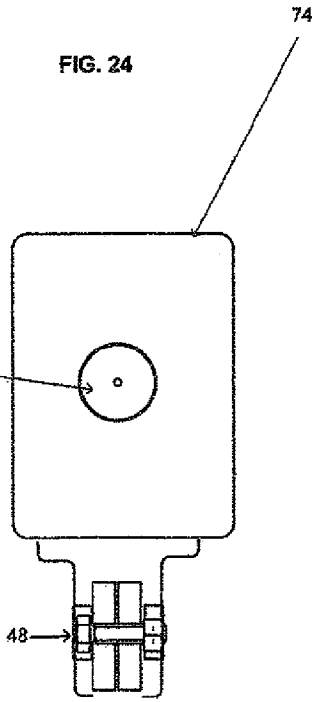
FIG. 24 illustrates a cross-sectional view along section line D-D' of FIG. 22.

FIG. 24 illustrates a cross-sectional view along section line D-D' of FIG. 22 showing barrel 50 and barrel exterior surface 74, and pivot pin 48.

Figure 25:
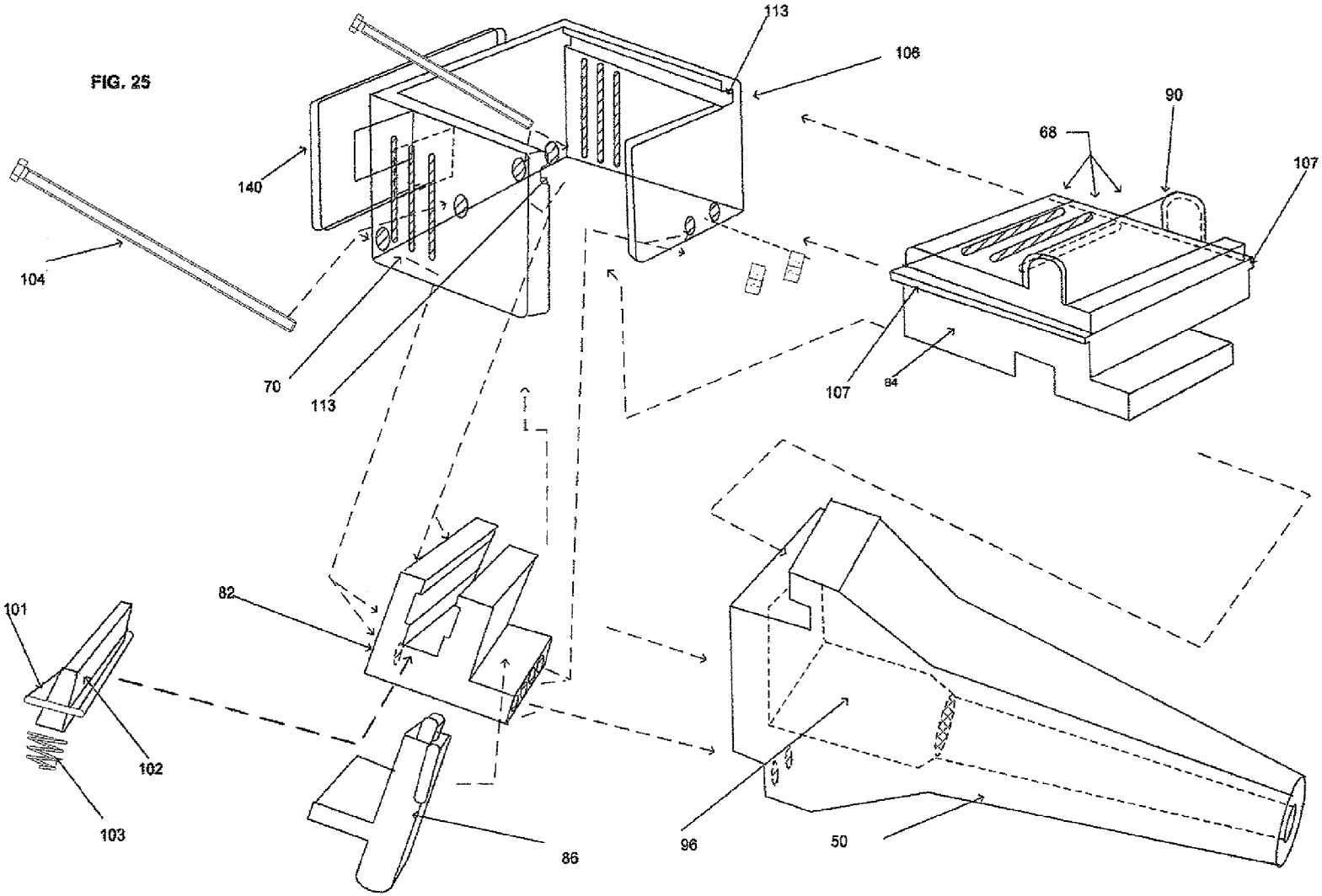
FIG. 25 illustrates a partial exploded view of an exemplary receiver portion of an exemplary embodiment of the present invention.

FIG. 25 illustrates a partial exploded view of an exemplary receiver portion of an exemplary embodiment of the present invention. Illustrated are various components including frame support plate 140, firing chamber side casing 106 having side ventilation slots 70, upper receiver casing 84 having upper ventilation slots 68 and outer shell of gas piston 90, barrel 50, firing chamber 96, blocking plate 86, receiver lower base 82, cartridge stopper plate 102, cartridge stopper plate spring 103, stopper plate spring fastener 101, and several receiver screws/bolts 104.

FIG. 26 illustrates a cross-sectional view along section line A-A' of FIG. 1. Illustrated is an exemplary arrangement of barrel 50, magazine shell 23, retractable butt stock rails 20, power source 26, and electronic microchip unit 64.

Figure 27:
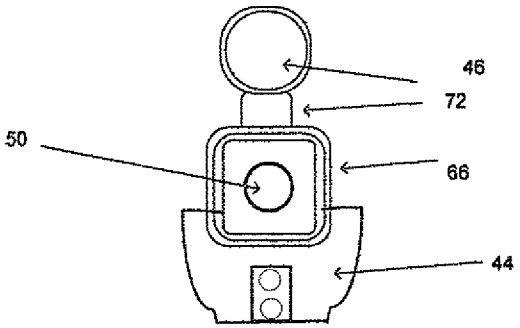
FIG. 27 illustrates a cross-sectional view along section line B-B' of FIG. 1.

FIG. 27 illustrates a cross-sectional view along section line B-B' of FIG. 1. Illustrated is an exemplary arrangement of barrel 50, scope 46, scope mount railing 72, frame to rail holding rings 66, and electric lines 44.

FIG. 28 illustrates a cross-sectional view of an exemplary ammunition/round 124, exemplary magazine 22 which may be suitable for use in an exemplary embodiment of the present invention as well as a magazine round stopper latch 122 which may cause magazine round stopper 120 of magazine 22 to be disengaged such that rounds 124 maybe expelled from magazine 22. Note that magazine round stopper latch 122 may be a portion of a firearm such as that illustrated in various figures herein. Also illustrated is frame support plate 140 (see also FIG. 3).

FIG. 29 illustrates an exemplary caseless ammunition round 124 which may be used in various embodiments of the present invention. Some exemplary ammunition may be comprised of bullet 128, solid propellant 130, and electric igniting propellant 132.

FIG. 30 illustrates a bullet 128 which may be used in various embodiments of the present invention.

Figure 31:
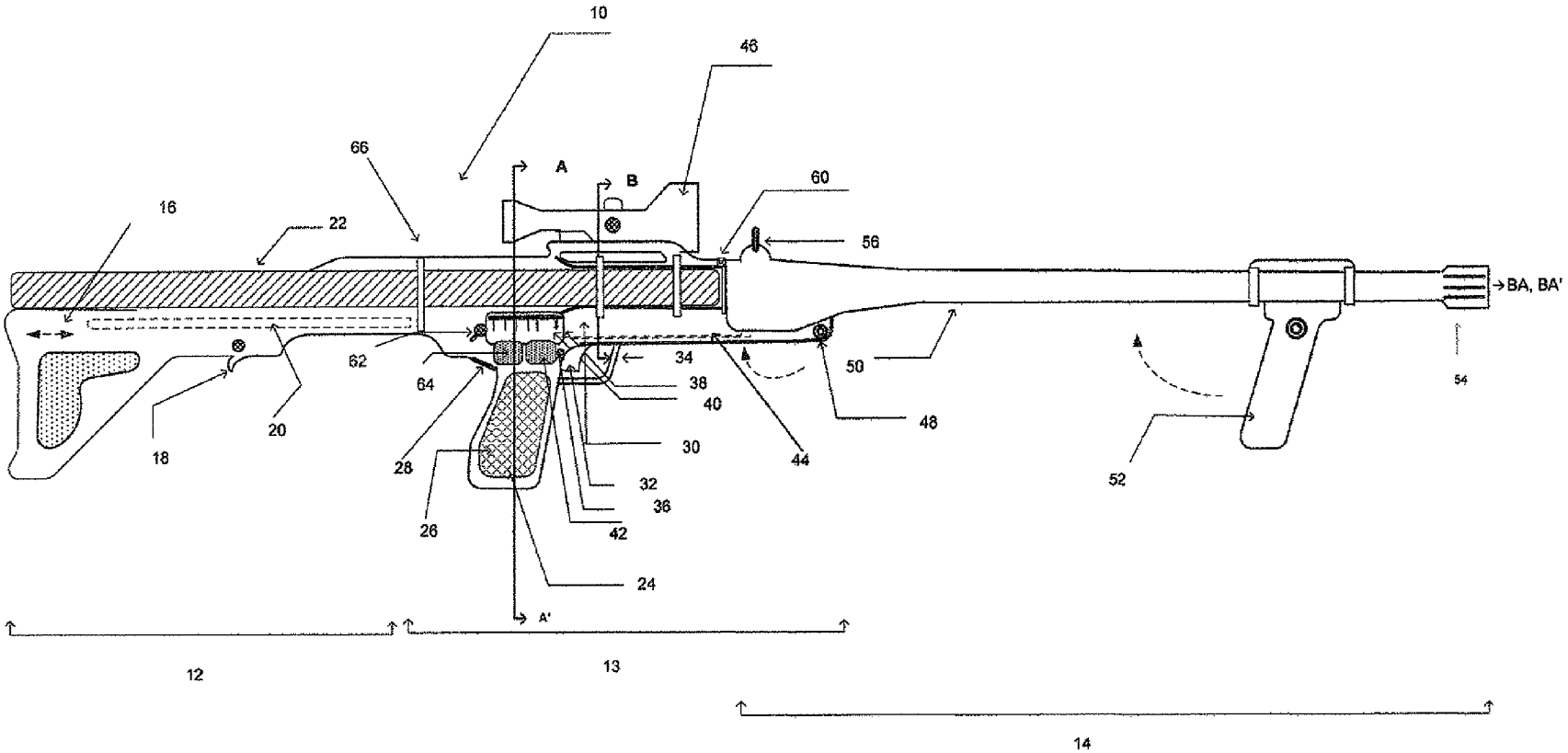
FIG. 31 illustrates a side cross-sectional view of a double barrel exemplary embodiment of the present invention.
Figure 32:
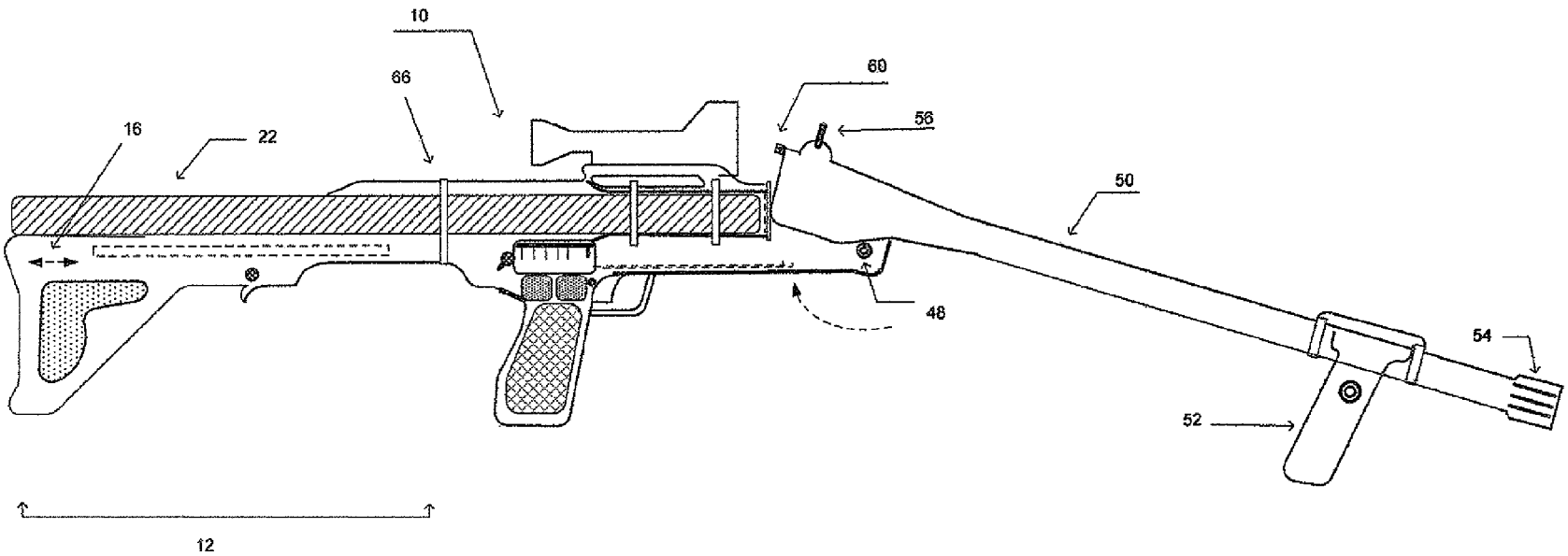
FIG. 32 illustrates a side cross-sectional view of the exemplary embodiment illustrated in FIG. 31 in a configuration to provide access to the firing chambers and barrels.
Figure 56:
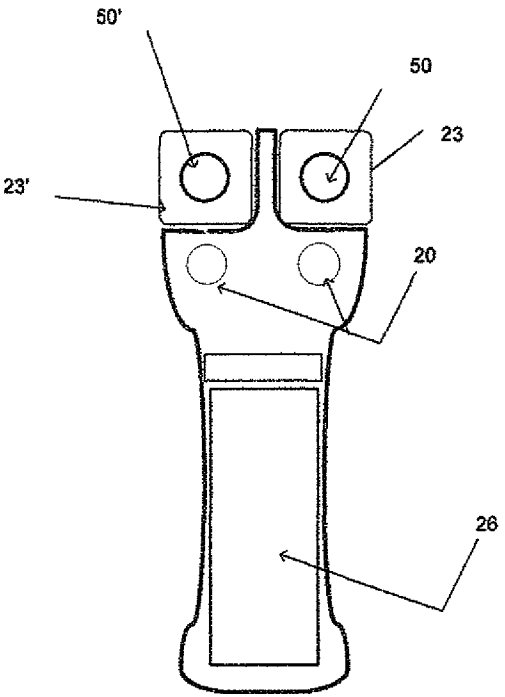
FIG. 56 illustrates a cross-sectional view along section line E-E' of FIG. 31.

FIG. 31 illustrates a side cross-sectional view of a double barrel exemplary embodiment of the present invention. Illustrated is firearm/weapon 10, stock 12, frame 13, barrel portion 14, retractable butt stock 16, butt stock latch 18, butt stock rail 20, ammunition slot/tubing 22, grip 24, optional internal power source 26, optional USB port 28, electronic compartments 30, trigger 32, trigger guard 34, trigger lock 36, safety 38, firing mode selection switch 40, trigger electric switch 42, electric lines 44, scope 46, barrel pivot pin 48, barrels 50, handle/grip 52, muzzle suppressor 54, bolt slide lever 56, frame breaking pin release 60, electric activating switch 62, electronic microchip unit 64, and frame to rail holding rings 66. Also illustrated are section line E-E' (wherein this sectional view is illustrated in FIG. 56) and section line F-F' (illustrated in FIG. 57). In this exemplary embodiment, firearm 10 is oriented to accommodate two magazines wherein the rounds in each of the magazines are positioned tip to end so that each bullet is pointing in the same direction about a common central axis CA (see FIG. 58). Each of these respective axis CA are then co-axial with a central axis BA of each respective barrel FIG. 32 illustrates a side cross-sectional view of the exemplary embodiment illustrated in FIG. 31 in a configuration for firing chamber and barrel access such that frame breaking pin release 60 has been released such that barrels 50 are pivoted with respect to frame 13 (and stock 12) such that the barrels 50 and firing chambers 96 are accessible to a user for cleaning, loading, unloading and maintenance purposes. Also illustrated in this view are retractable butt stock 16, ammunition slot/tubing 22, barrel pivot pin 48, handle/grip 52, muzzle suppressor 54, bolt slide lever 56, and frame to rail holding rings 66.

Figure 33:
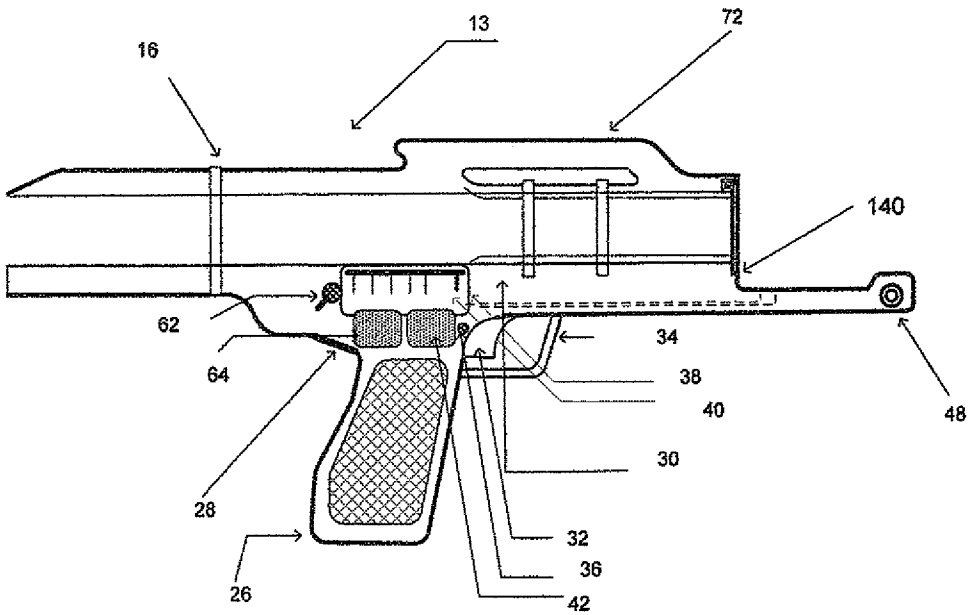
FIG. 33 illustrates a side cross-sectional side view of an exemplary main frame/receiver portion of the exemplary embodiment of FIGS. 31-32.

FIG. 33 illustrates a side cross-sectional side view of an exemplary main frame/receiver portion of the exemplary embodiment of FIGS. 31-32. Illustrated in this exemplary frame 13 is retractable butt stock 16, frame support plate 140, pivot pin 48, power source 26, optional USB port 28, electronic compartments 30, trigger 32, trigger guard 34, trigger lock 36, safety 38, firing mode selection switch 40, trigger electric switch 42, electric activating switch 62, electronic microchip unit 64, and scope mount railing 72.

Figure 34:
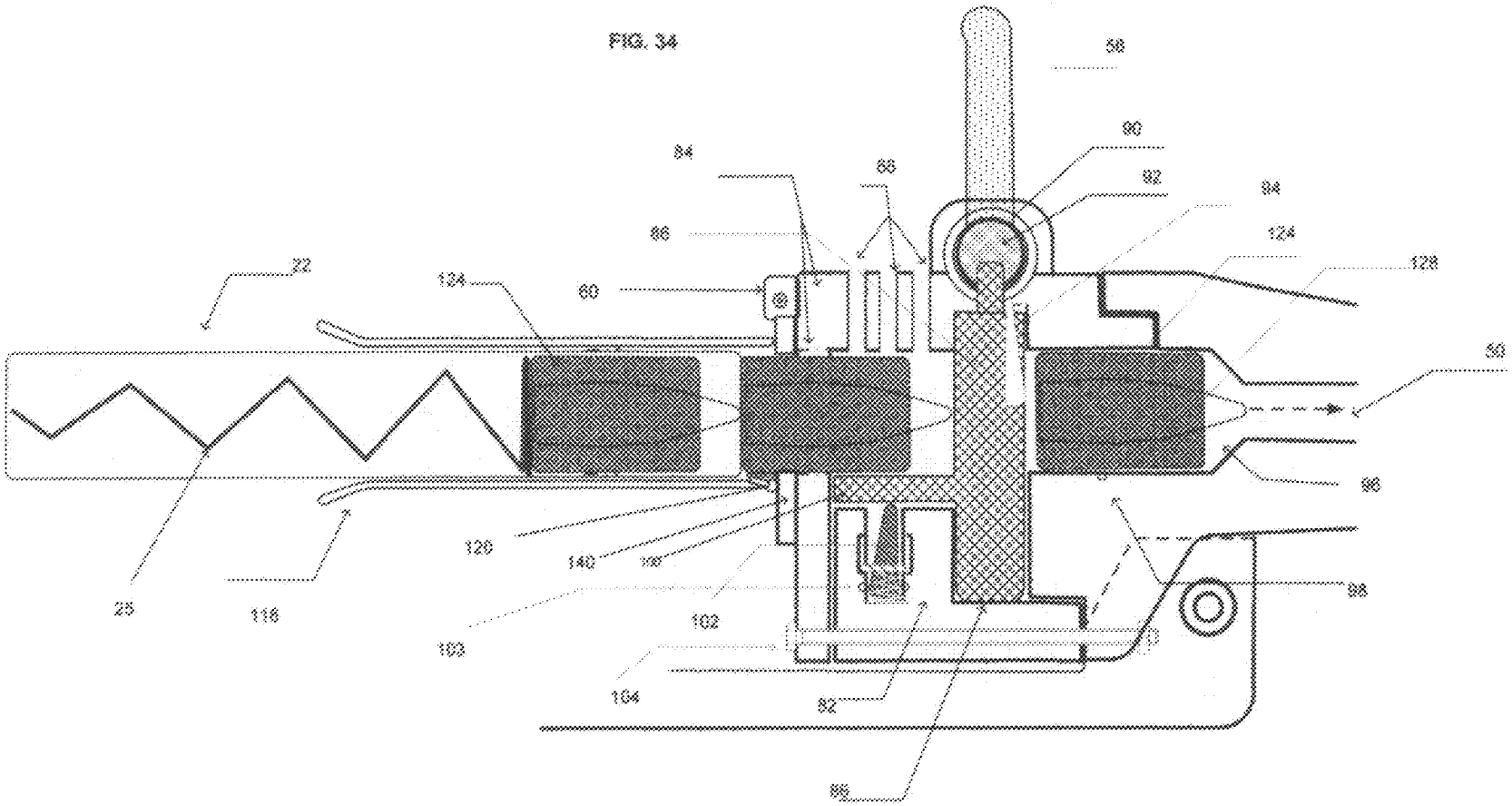
FIG. 34 illustrates a cross-sectional side view of a receiver portion of an exemplary embodiment of the present invention.

FIG. 34 illustrates a cross-sectional side view of a receiver portion of the exemplary embodiment of FIGS. 31-33. Illustrated are ammunition slot/tubing/magazines 22, magazine loading springs 25, magazine feed ramps 118, frame breaking pin release 60, firing chamber lock/blocking plate 86, receiver casing 84 (may be removable), slots 88 (for ventilation), bolt slide lever 56, outer shell of gas piston 90, inner gas piston 92, gas escape slot/gap 94, firing chamber 96, barrel 50, bullet 128, caseless round/cartridge 124, magazine round stopper 120, cartridge stopper plate spring 103, cartridge stopper plate 102, blocking plate lip 100, frame support plate 140, receiver screws 104, receiver lower base 82, and firing electrode/electric pins 98 (may be multiple).

FIG. 35 illustrates a cross-sectional top view of a receiver portion of the exemplary embodiment of FIGS. 31-34. Illustrated are magazines 22, magazine feed ramps 118, magazine loading springs 25, caseless round/cartridges 124, frame support plate 140, firing chamber side casing 106, outer shell of gas piston 90, gas piston service port 116, upper safety lever open slot 110, gas escape slot/gap 94, firing chambers 96, 96' (note that although this illustration refers to various elements with ', this is only to differentiate the components when there are multiples and such designations are only for convenience, i.e., other figures such as FIGS. 31-34 reference these components without such designations and should be understood to include both those with and without the '), barrels 50, 50', bullets 128, firing electrode/electric pins 98, firing chamber lock/blocking plate 86, tip of bullet 114, cartridge stopper plate springs 103, 103', blocking plate lip 100, and frame breaking pin release 60.

Figure 36:
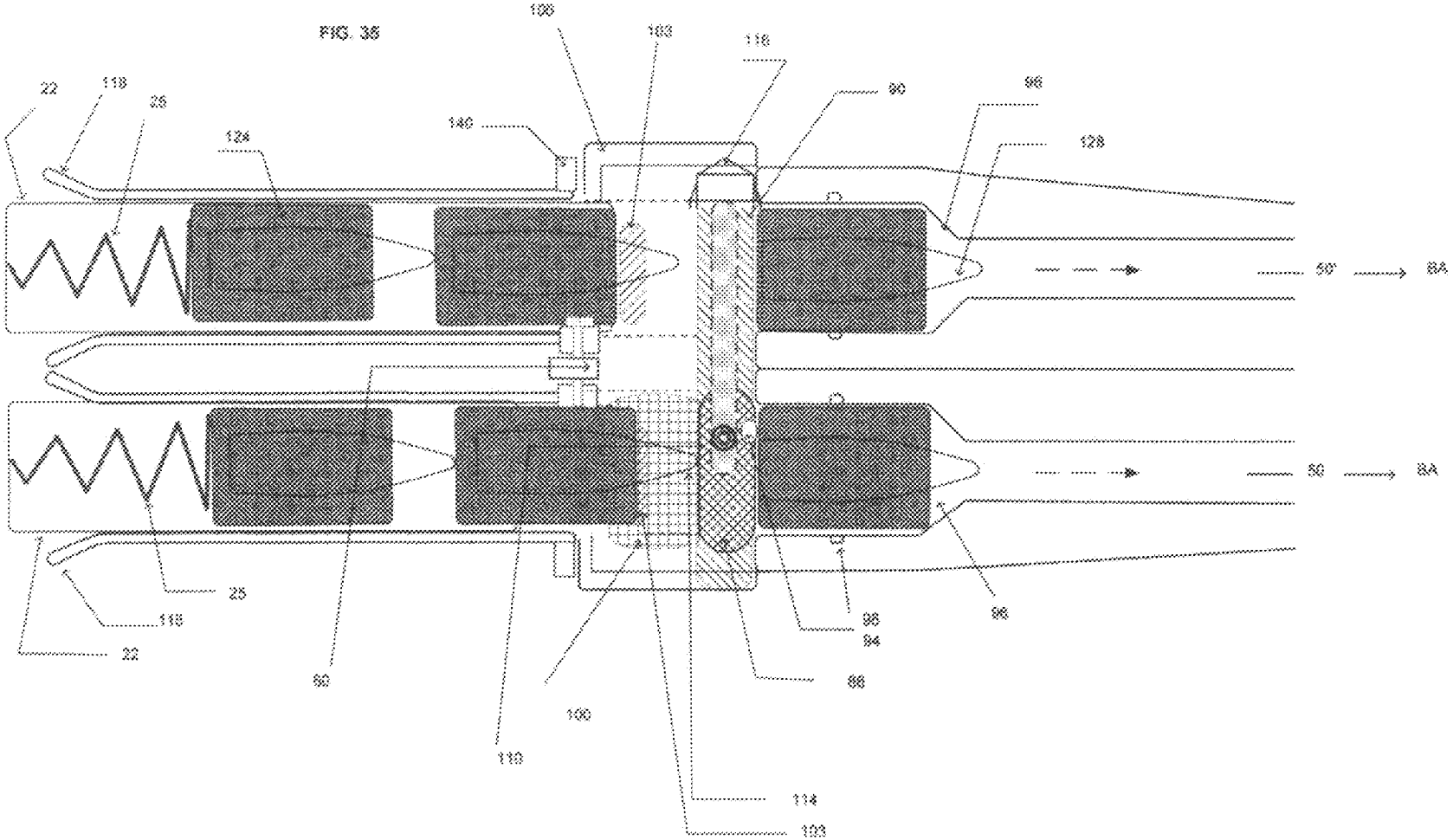
FIGS. 36A-F illustrate cross-sectional views of an exemplary receiver portion of an exemplary embodiment of the present invention at various stages of firing a round.
Figure 36B:
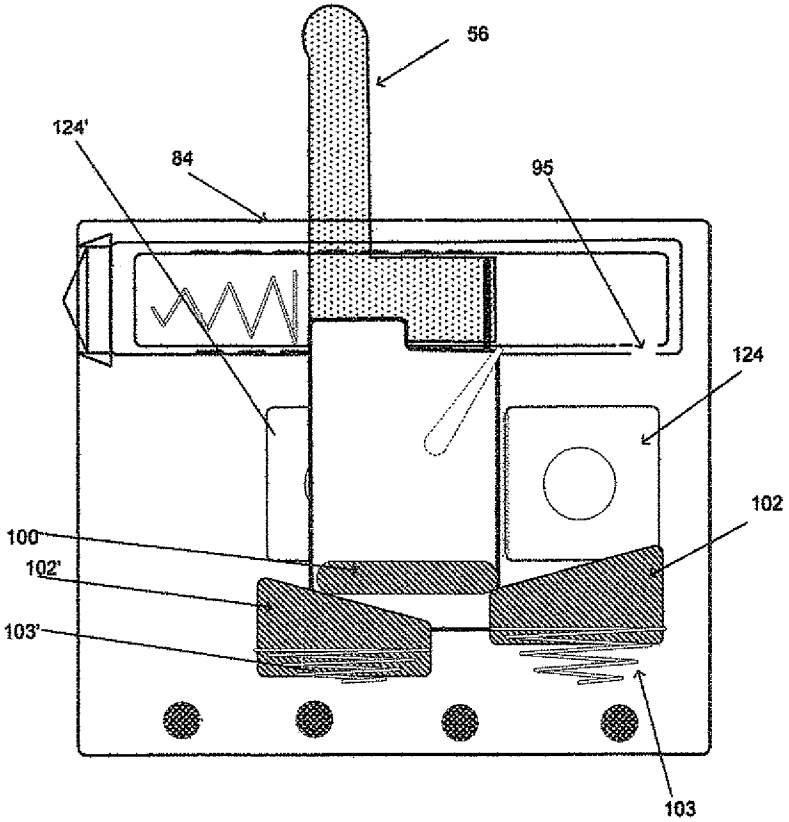
Figure 36A:
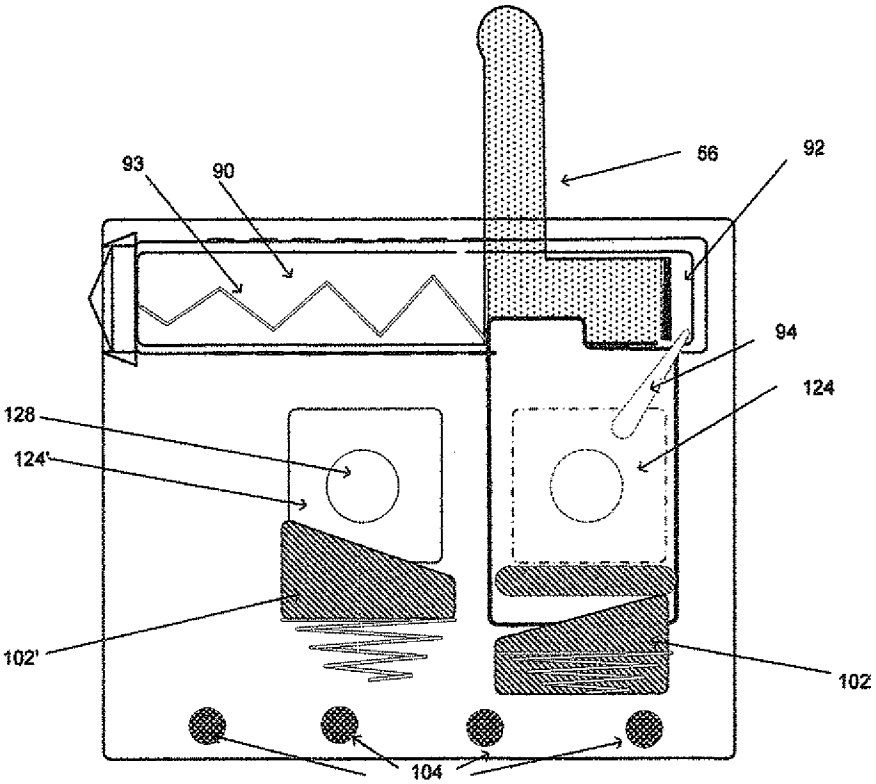

FIGS. 36A-F illustrate cross-sectional views of an exemplary receiver portion and blocking plate 86 of an exemplary double barrel embodiment of the present invention at various stages of firing rounds from the two barrels. FIG. 36A illustrates a stage wherein there is an unfired round 124 in firing chamber 96 (i.e., the barrel on the right hand side of the illustration) and an unfired round 124' in firing chamber 96'. In this embodiment, bolt slide lever 56 is in contact with blocking plate 86 and, thus, blocking plate 86 is also biased to the "closed" condition illustrated. In this "closed" condition, blocking plate 86 seals off the end of the firing chamber 96 (see FIG. 37B). Though this embodiment illustrates bolt slide lever 56 and blocking plate 86 as being two separate, though connected, components, they may also be constructed as a unitary piece. Also illustrated are outer shell of gas piston 90, inner gas piston 92, gas escape slot/gap 94, firing chamber 96, barrel 50, and gas piston service port 116.

In this configuration/condition, cartridge stopper plate 102 is biased in an "upward" position by cartridge stopper plate spring 103. In this condition, an upper surface of cartridge stopper plate 102 may be in contact with a lower surface of blocking plate lip 100.

Upon firing of round 124, some of the exhaust gas from the explosion may be routed through gas escape gap 94 such that some of the exhaust gas enters into inner gas piston 92. As this gas enters into this confined space, bolt slide lever 56 (and thereby blocking plate 86) is urged to move laterally (i.e., left in the illustration) against the force of gas piston spring 93 (note that other biasing means may be used in lieu of a spring). As blocking plate 86 moves to the left, it will close firing chamber 96' and round 124' and a new unfired round can be loaded into firing chamber 96 as illustrated in FIG. 35B. Note that in the embodiment illustrated in FIGS. 36A-F, only one firing chamber may be fired at a time because there is only one blocking plate and it must be in a stage where it is closing the firing chamber in order for the round to be fired.

FIG. 36B illustrates a stage in which a new unfired round has been placed into firing chamber 96 and cartridge stopper plate 102 has moved upward to prevent a second unfired round from entering the chamber. At this stage, firing chamber 96' has not yet completely closed, so round 124' cannot yet be fired. Note that as blocking plate b, and thereby blocking plate 100 moves, it may cause cartridge stopper plate 102' to be lowered, so that a new unfired round is then ready to be loaded after round 124' has been fired (a similar mechanism may be present in various embodiments of the present invention, such as that described above for a single barrel embodiment as illustrated in, for example, FIGS. 6A-D). Also illustrated in FIG. 36B is receiver casing 84.

Figure 36D:
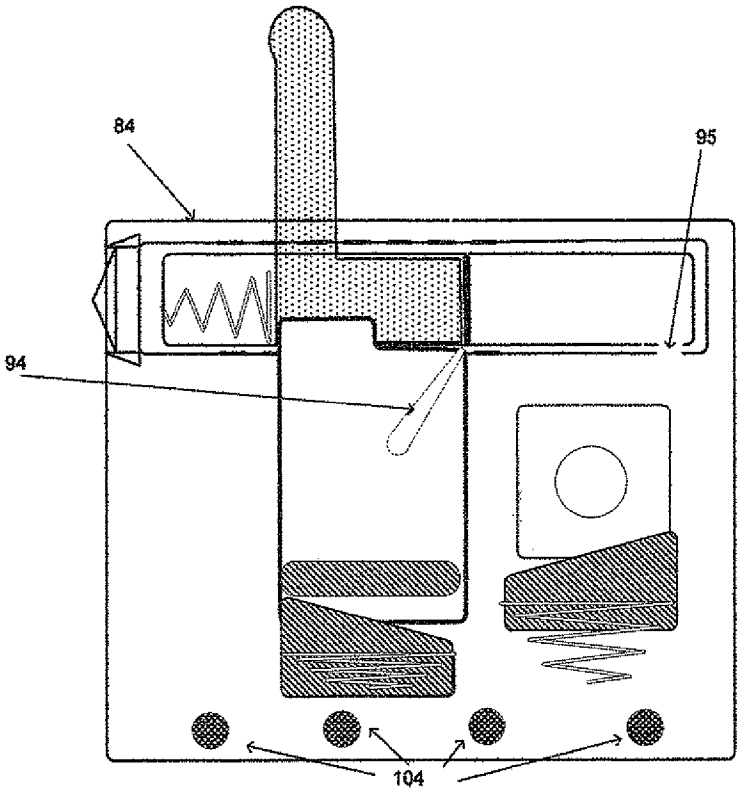
Figure 36C:
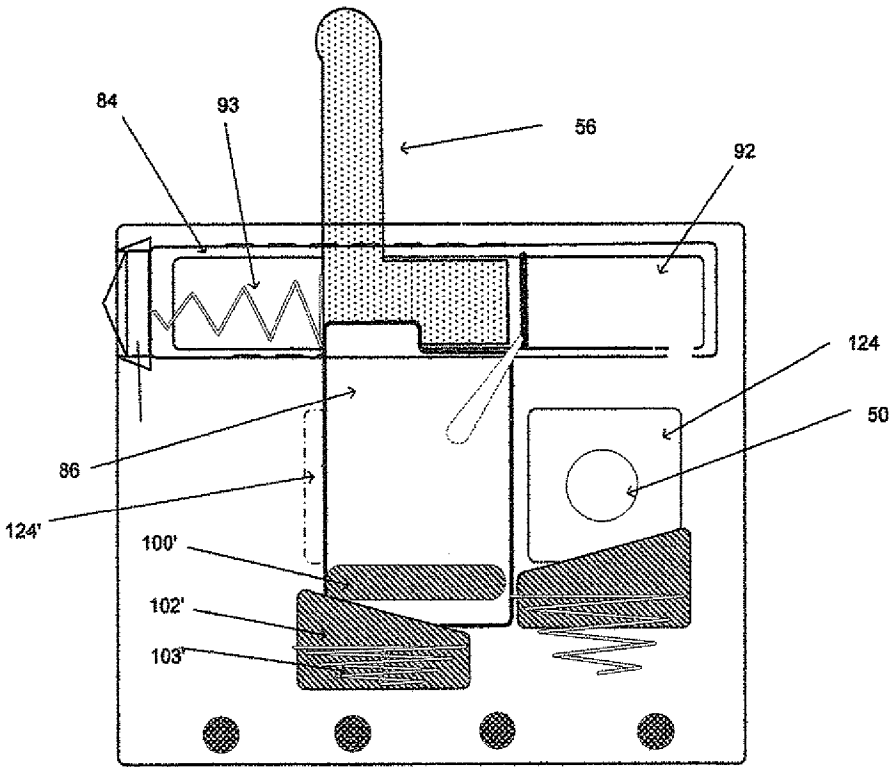

FIG. 36C illustrates another intermediate stage in which firing chamber 96', and unfired round 124' are not yet fully closed, so not yet able to be fired. At this stage, there is an unfired round in each of firing chambers 96, 96'.

FIG. 36D illustrates a stage in which firing chamber 96' is now fully closed and round 124' is ready to be fired. Upon firing of round 124', blocking plate 86 is now moved to the right hand side of the illustration via biasing means such as gas piston spring 93. FIG. 36D also illustrates a location for gas link port 95.

Figure 36F:
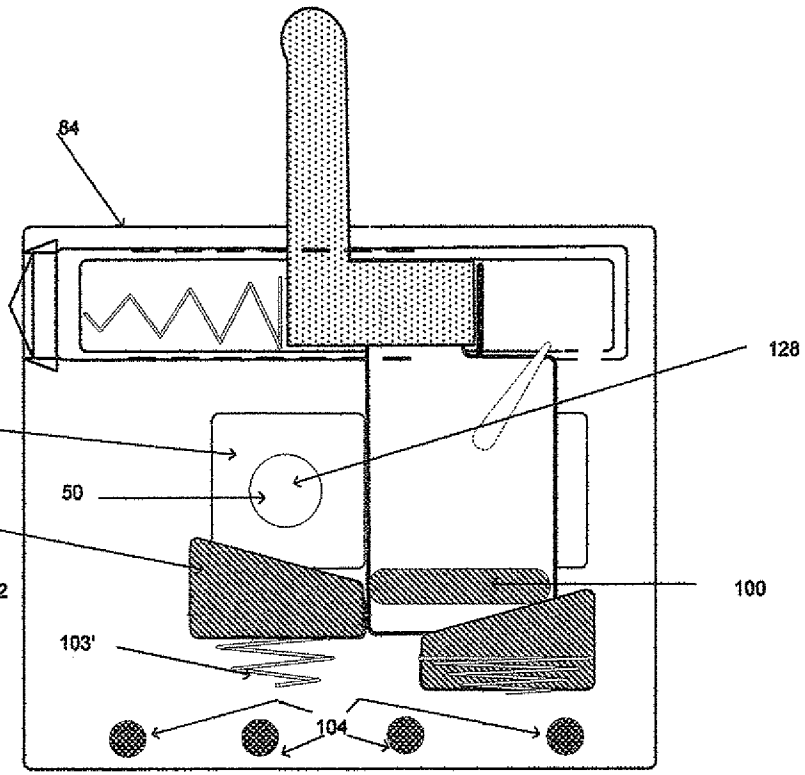
Figure 36E:
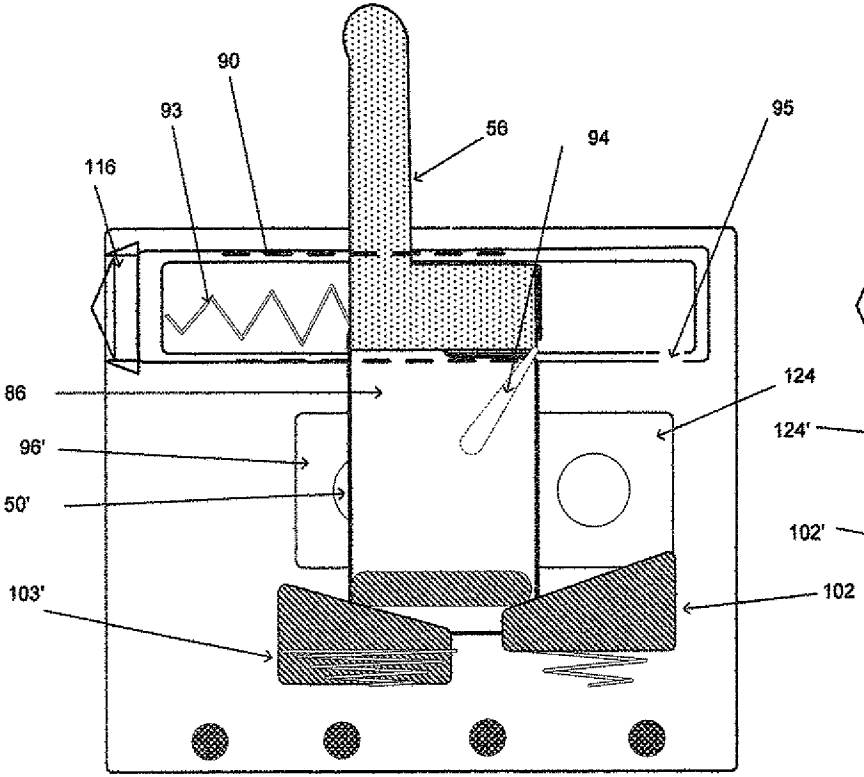

FIG. 36E illustrates an intermediate stage in which firing chamber 96' and barrel 50' are empty and firing chamber 96 has an unfired round 124 therein. Note that as blocking plate 86 moves back toward firing chamber 96, cartridge stopper plate 102 is urged downward and stopper plate 102' will return to it's upward position to prevent more than one round from entering firing chamber 96'.

FIG. 36F illustrates a stage wherein blocking plate 86 is almost enclosing firing chamber 96 and a new round 124' has now been loaded into firing chamber 96' and cartridge stopper plate 102' prevents a second unfired cartridge from entering firing chamber 96'. As blocking plate 86 moves to the right in the illustration, cartridge stopper plate 102 is urged downward and the unfired round that it was restraining from entering firing chamber 96 (which is already occupied by a first unfired round), now may impact a surface of blocking plate 86 such that blocking plate 86 presents a physical barrier to this second round entering firing chamber 96 (and that cartridge stopper plate 102 is no longer a physical barrier to such movement as shown in FIG. 34-35). At the stage illustrated in FIG. 36F, neither firing chambers 96, 96' is ready to be fired. Blocking plate 86 may continue to move to the right so that firearm 10 is then in the stage illustrated in FIG. 36A in which firing chamber 96 is ready to be fired and firing chamber 96' is loaded with an unfired round.

As discussed above, if the firearm is unloaded to start, a user may manually load rounds into firing chambers 96, 96' by placing the weapon into the configuration of FIG. 32, or my sliding bolt slide lever 56 to cycle through the various stages to load a round into each chamber (note that FIGS. 36A-36F could be accomplished in a single pull of bolt slide lever 56).

Figures 37A, 37B, 38, 39A, 39B, 40A, 40B, 41:
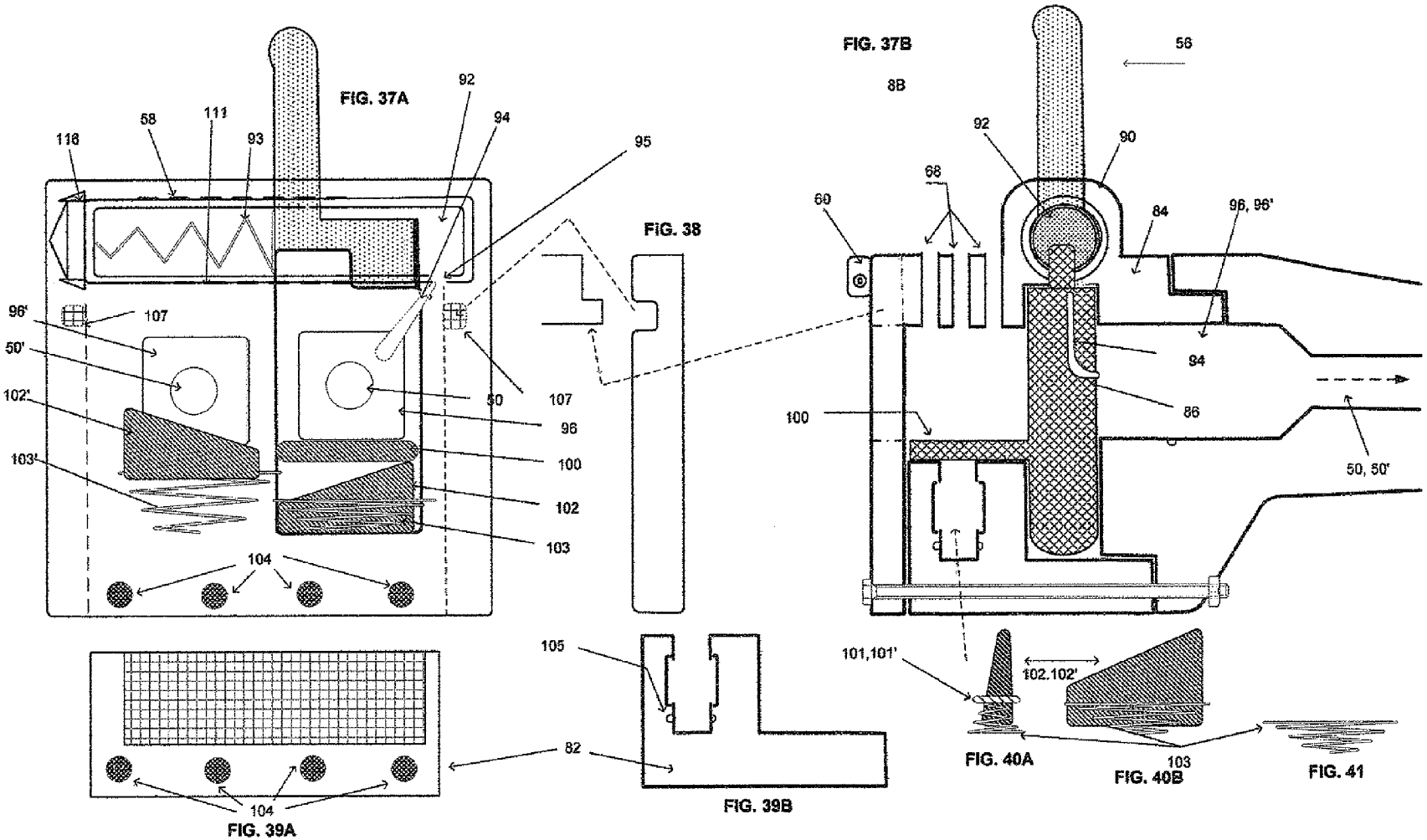
FIGS. 37A-B illustrate cross-sectional end and side views of a receiver portion of an exemplary embodiment of the present invention.
FIG. 38 illustrates a relationship between various members of an exemplary embodiment of the present invention.
FIGS. 39A-B illustrate a receiver lower base portion of an exemplary embodiment of the present invention in frontal and side views, respectively.
FIGS. 40A-B illustrate a cartridge stopper plate and cartridge stopper plate spring portion of an exemplary embodiment of the present invention in side and frontal views, respectively.
FIG. 41 illustrates an exemplary cartridge stopper plate spring portion of an exemplary embodiment of the present invention.

FIGS. 37A-B illustrate cross-sectional end and side views, respectively, of a receiver portion of an exemplary embodiment of the present invention. Illustrated are safety lever open slot in upper sleeve casing 58, casing slide notch 107, lower safety lever open slot 111, blocking plate lip 100, receiver screws/holes 104, gas escape 94, inner gas piston 92, firing chambers 96, 96', barrels 50, 50', cartridge stopper plates 102, 102', cartridge stopper plate springs 103, 103', and receiver screws/holes 104.

FIG. 37B illustrates an arrangement for an exemplary receiver portion showing bolt slide lever 56, outer shell of gas piston 90, upper receiver casing 84, firing chambers 96, 96', gas escape gap 94, blocking plate 86, blocking plate lip 100, firing chamber side casing 106, frame breaking pin release 60, upper ventilation slots 68, and inner gas piston 92.

FIG. 38 illustrates a relationship between various members of an exemplary embodiment of the present invention. Slot 113 of firing chamber side casing 106 is shaped to accommodate and mate with casing slide notch 107 to fix the relationship between the various members.

FIGS. 39A-B illustrate a receiver lower base portion 82 of an exemplary embodiment of the present invention in frontal and side views, respectively. Also illustrated are various receiver screws/holes 104 (i.e., a number of holes through which bolts or screws maybe inserted in order to connect two or members together in a fixed, but removable, relationship), spring anchor 105 which limits the ability of cartridge stopper plate 102 to move, and a channel in which cartridge stopper plate 102 may move.

FIGS. 40A-B illustrate cartridge stopper plates 102, 102' and cartridge stopper plate springs 103, 103' of an exemplary embodiment of the present invention in side and frontal views, respectively. Also illustrated are stopper plate spring fasteners 101, 101'.

FIG. 41 illustrates an exemplary cartridge stopper plate springs 103, 103' portion of an exemplary embodiment of the present invention.

FIG. 42 illustrates a cross sectional top view of an exemplary blocking plate 86 of an exemplary embodiment of the present invention. Illustrated is an arrangement for blocking plate 86 with blocking plate lip 100, lock plate bolt 85, and gas escape gap 94.

FIGS. 43A-B illustrate cross-sectional side and frontal views, respectively, of the exemplary blocking plate portion of FIG. 42 showing bolt slide lever 56, blocking plate 86, gas escape gap 94, blocking plate lip 100, lock plate bolt 85, and lock plate bolt socket 87. Note that FIG. 13B is an exploded view and that when fully installed, lock plate bolt 85 may be received into lock plate bolt socket 87.

FIG. 44 illustrates a top view of another exemplary blocking plate 86 of an exemplary embodiment of the present invention. In this embodiment, there is a cutaway/angled portion Φ. In some embodiments, it may be advantage to have such an angled portion in order to push a partially inserted round fully into the firing chamber. Illustrated is an arrangement for blocking plate 86, blocking plate lip 100, lock plate bolt 85, and gas escape gap 94.

FIGS. 45A-B illustrate top cross-sectional side and top views, respectively, side and top views, respectively of an exemplary piston assembly portion of the present invention. Illustrated in FIG. 45A is an exemplary embodiment relationship of gas piston service port 116, gas piston spring 93, upper safety lever open slot 110, lower safety lever open slot 111, inner gas piston 92, and gas link port 95.

FIG. 45B illustrates a top view of a safety lever open slot in upper sleeve casing 58, and gas piston service port 116.

Figures 46A, 46B, 47, 48A, 48B, 49A, 49B, 50:
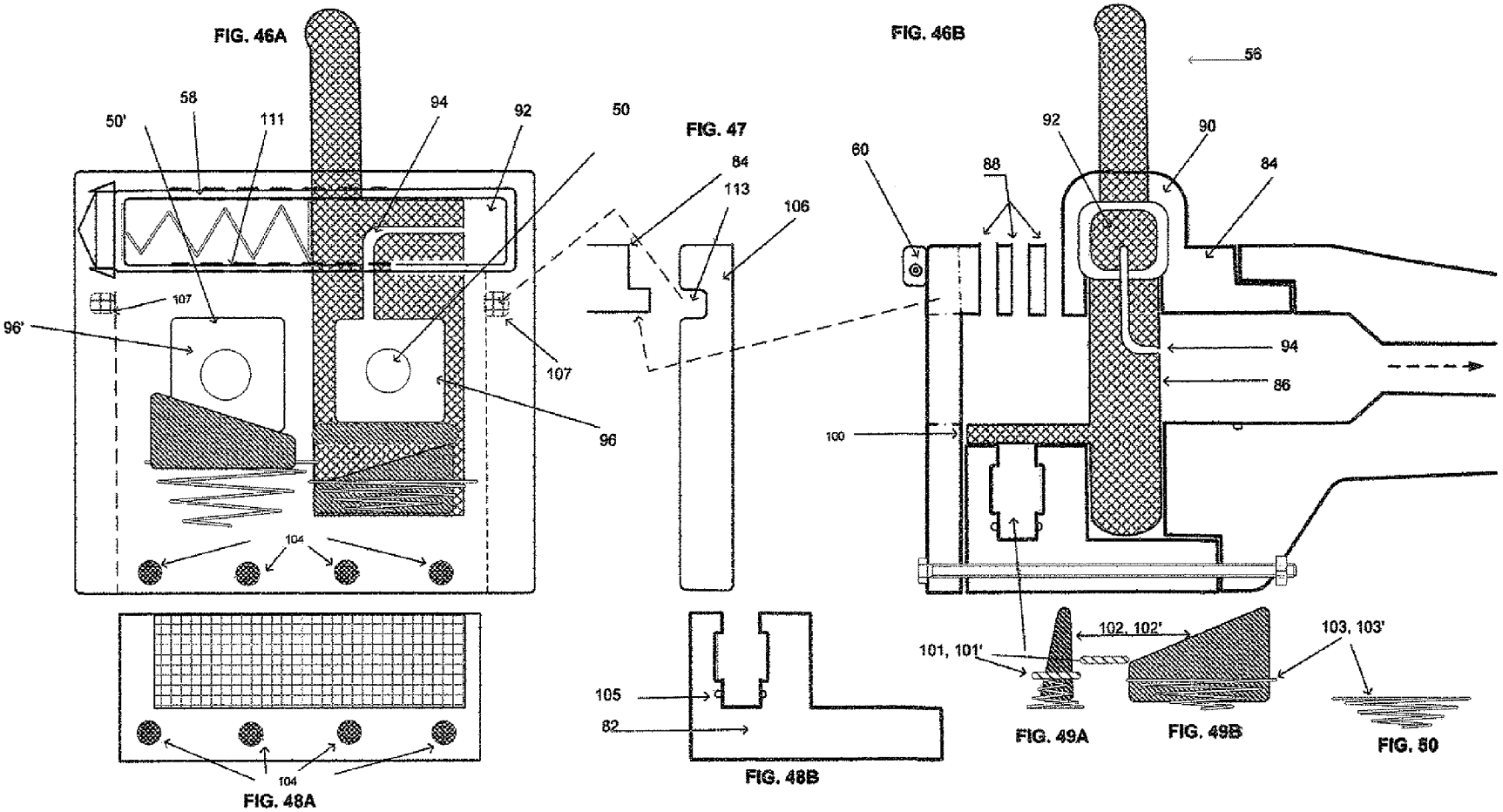
FIGS. 46A-B illustrate cross-sectional end and side views of a receiver portion of another exemplary embodiment of the present invention.
FIG. 47 illustrates a relationship between various members of an exemplary embodiment of the present invention.
FIGS. 48A-B illustrate a receiver lower base portion of another exemplary embodiment of the present invention in frontal and side views, respectively.
FIGS. 49A-B illustrate a cartridge stopper plate and cartridge stopper plate spring portion of an exemplary embodiment of the present invention in side and frontal views, respectively.
FIG. 50 illustrates an exemplary cartridge stopper plate spring portion of an exemplary embodiment of the present invention.

FIGS. 46A-B illustrate cross-sectional end and side views, respectively, of a receiver portion of another exemplary embodiment of the present invention. Illustrated are safety lever open slot in upper sleeve casing 58, casing slide notch 107, lower safety lever open slot 111, blocking plate lip 100, receiver screws/holes 104, gas escape 94, and inner gas piston 92. In this exemplary embodiment, gas escape 94 takes an alternate route for exhaust gas to enter inner gas piston 92.

FIG. 46B illustrates a side view of the exemplary receiver portion of FIG. 46A showing bolt slide lever 56, outer shell of gas piston 90, upper receiver casing 84, firing chamber 96, gas escape gap 94, blocking plate 86, blocking plate lip 100, firing chamber side casing 106, frame breaking pin release 60, upper ventilation slots 68, and inner gas piston 92.

FIG. 47 illustrates a relationship between various members of an exemplary embodiment of the present invention.

FIGS. 48A-B illustrate a receiver lower base portion of another exemplary embodiment of the present invention in frontal and side views, respectively. Illustrated is a receiver lower base portion 82 of an exemplary embodiment of the present invention in frontal and side views, respectively. Also illustrated are various receiver screws/holes 104 (i.e., a number of holes through which bolts or screws maybe inserted in order to connect two or members together in a fixed, but removable, relationship), spring anchor 105 which limits the ability of cartridge stopper plates 102, 102' to move, and a channel in which cartridge stopper plates 102, 102' may move.

FIGS. 49A-B illustrate cartridge stopper plates 102, 102' and cartridge stopper plate springs 103, 103' of an exemplary embodiment of the present invention in side and frontal views, respectively. Also illustrated is stopper plate spring fasteners 101, 101'.

FIG. 50 illustrates an exemplary cartridge stopper plate springs 103, 103' of an exemplary embodiment of the present invention.

Figure 51B:
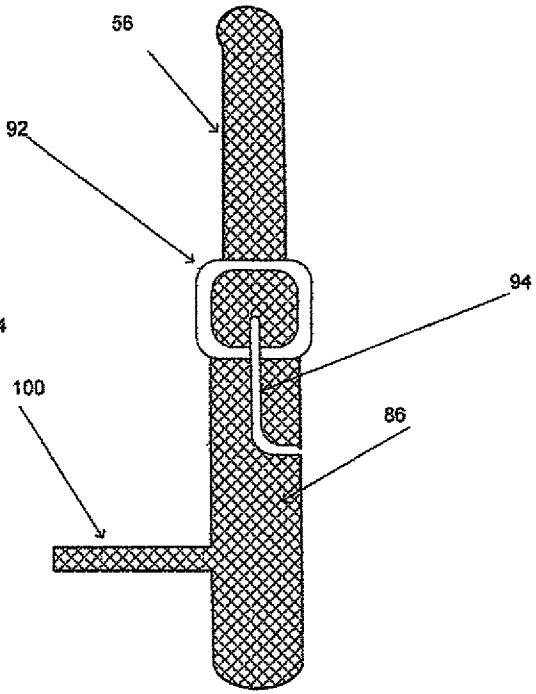
FIGS. 51A-B illustrate frontal and side cross-sectional views of another exemplary blocking plate portion of the present invention.
Figure 51A:
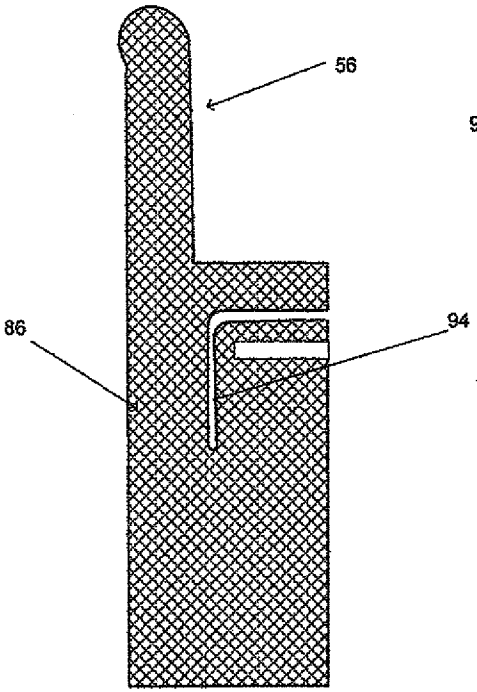

FIGS. 51 A-B illustrate cross-sectional frontal and side views, respectively, of the exemplary blocking plate 86 and bolt slide lever portion of FIGS. 46A-B in which they may comprise a single component. Illustrated is an arrangement showing bolt slide lever 56, blocking plate 86, inner gas piston 92, gas escape gap 94, blocking plate lip 100, and lock plate bolt 85.

Figure 52:
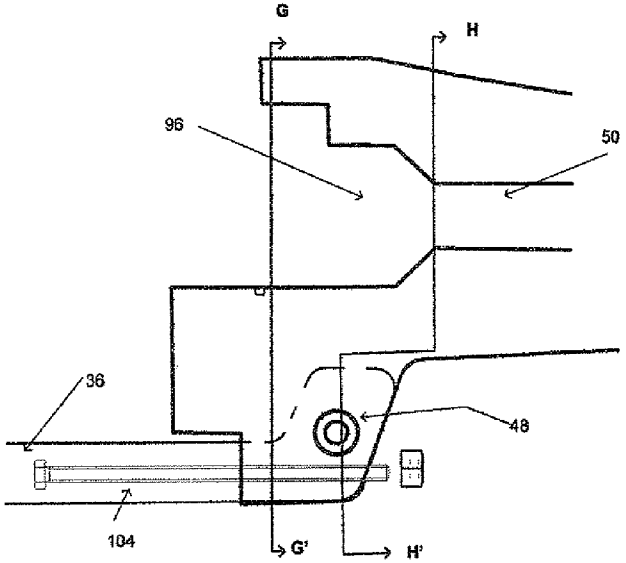
FIG. 52 illustrates a cross-sectional view of a receiver and barrel portion of another exemplary embodiment of the present invention.

FIG. 52 illustrates a cross-sectional view of an exemplary receiver and barrel portion of an exemplary embodiment of the present invention illustrating a portion of firing chambers 96, 96', barrels 50, 50', pivot pin 48, and receiver screws/holes 104. Also illustrated are section lines G-G', and H-H' as further illustrated in FIGS. 53-54.

Figure 53:
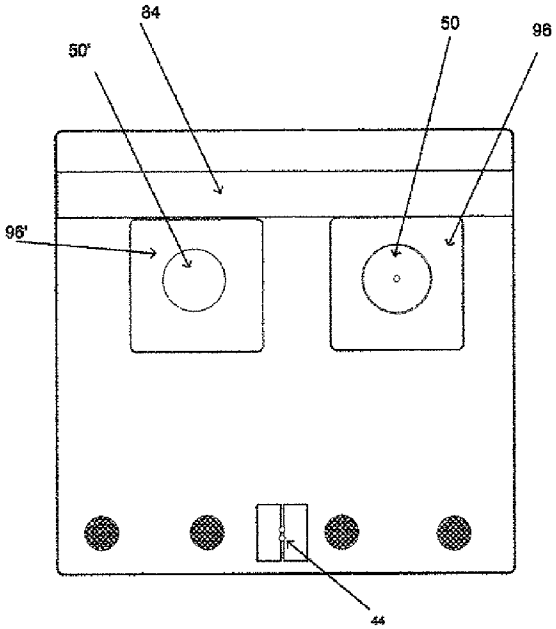
FIG. 53 illustrates a cross-sectional view along section line G-G' of FIG. 52.

FIG. 53 illustrates a cross-sectional view along section line G-G' of FIG. 22. An arrangement of upper receiver casing 84, firing chambers 96, 96', and barrels 50, 50' is illustrated.

Figure 54:
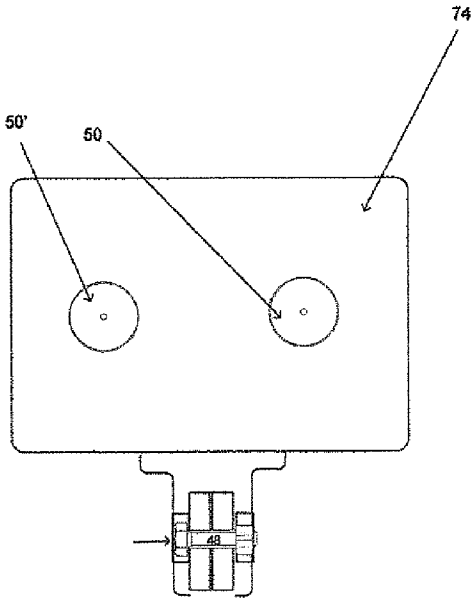
FIG. 54 illustrates a cross-sectional view along section line H-H' of FIG. 52.

FIG. 54 illustrates a cross-sectional view along section line H-H' of FIG. 52 showing barrels 50, 50' and barrel exterior surface 74, and pivot pin 48.

Figure 55:
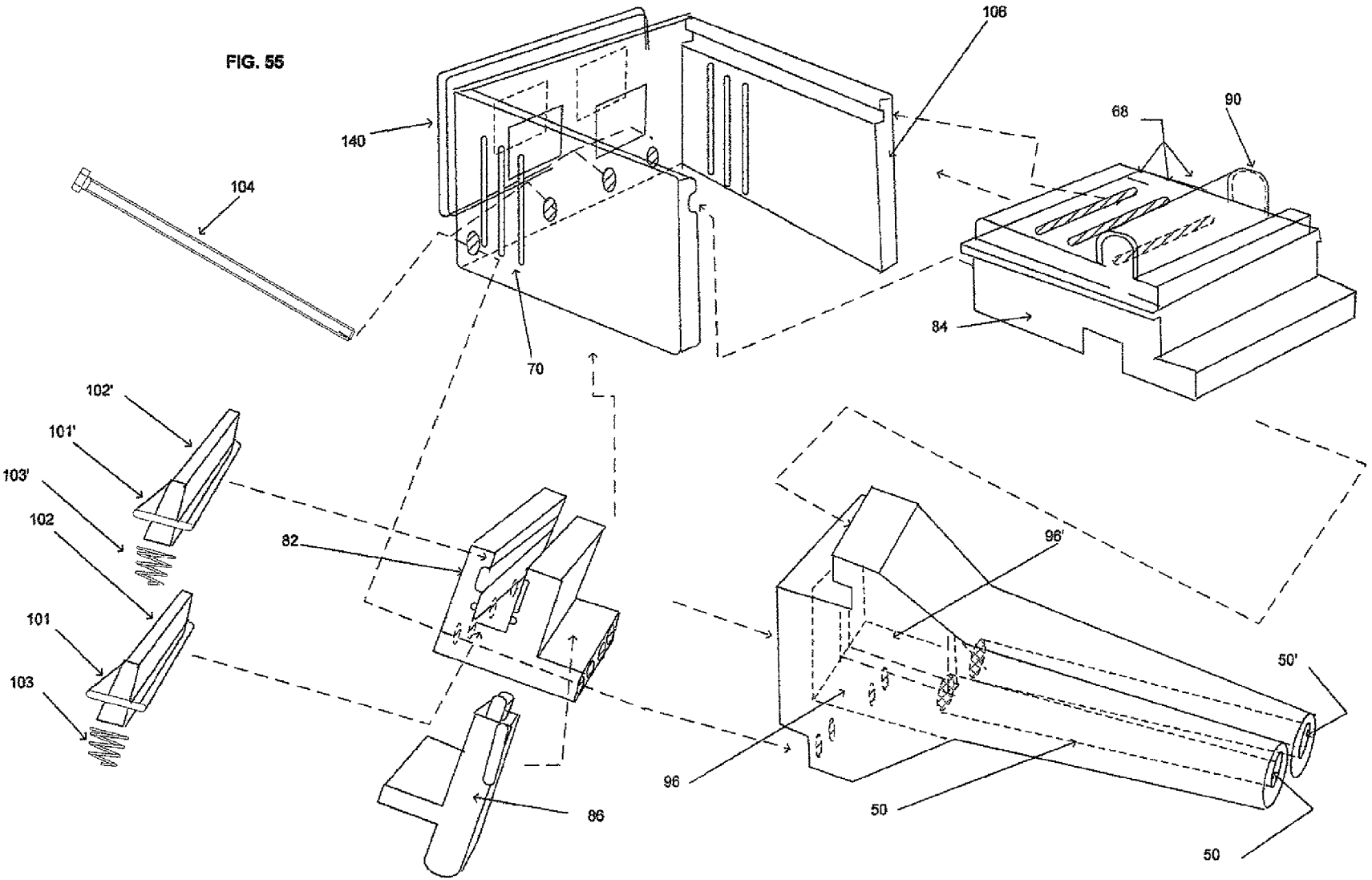
FIG. 55 illustrates a partial exploded view of an exemplary receiver portion of an exemplary embodiment of the present invention.

FIG. 55 illustrates a partial exploded view of an exemplary receiver portion of an exemplary embodiment of the present invention. Illustrated are various components including frame support plate 140, firing chamber side casing 106 having side ventilation slots 70, upper receiver casing 84 having upper ventilation slots 68 and outer shell of gas piston 90, barrels 50, 50', firing chambers 96, 96', blocking plate 86, receiver lower base 82, cartridge stopper plates 102, 103', cartridge stopper plate springs 103, 103', stopper plate spring fasteners 101, 101', and several receiver screws/bolts 104.

FIG. 56 illustrates a cross-sectional view along section line E-E' of FIG. 31. Illustrated is an exemplary arrangement of barrels 50, 50', magazine shells 23, 23', retractable butt stock rails 20, power source 26, and electronic microchip unit 64.

Figure 57:
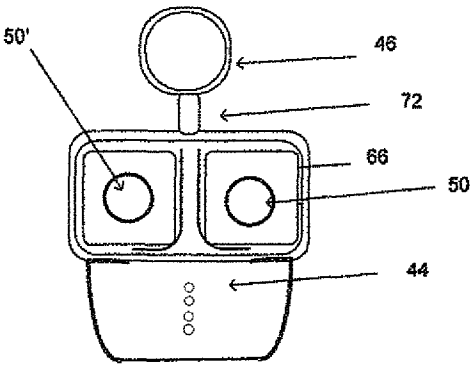
FIG. 57 illustrates a cross-sectional view along section line F-F' of FIG. 31.

FIG. 57 illustrates a cross-sectional view along section line F-F' of FIG. 31. Illustrated is an exemplary arrangement of barrels 50, 50', scope 46, scope mount railing 72, frame to rail holding rings 66, and electric lines 44.

Note that the various components illustrated in FIGS. 28-30 may also be used in accordance with the embodiments of FIGS. 31-37 in either one, two, or more barrel configurations.

In some embodiments, a central axis of two or rounds/cartridges may be coaxial with an axis CA, and this axis CA may be parallel to an axis BA of the associated barrel through which the rounds are fired. In other embodiments, axis CA may be co-axial with the associated barrel's axis BA.

In some embodiments with two or more barrels, a single trigger pull may fire two or more shots. For example, in the embodiment illustrated in FIGS. 31-35, a single trigger pull may go through all of the stages illustrated in FIGS. 36A-F. Some embodiments may have automatic fire, wherein a single trigger pull causes the firearm to fire a high number of rounds.

Some embodiments of the present invention may include one or more optional internal power sources 26. Such power sources include, but are not limited to, conventional batteries, rechargeable batteries, Nickel cadmium batteries, and lithium ion batteries. Such power sources may provide power for one or more firearm systems including, but not limited to, electronic firing systems, data acquisition systems, various computer systems, a powered scope, trigger safeguards (including, but not limited to, an electronic fingerprint reader), and a database for recording data related to firearm and other activities (such as recording how may shots were fired and by which user, sounds in the vicinity of the firearm, etc).

Blocking plate 86 performs two essential functions: (1) one or more of its' surfaces form a part of firing chamber 96, and (2) it presents a physical barrier to more than one live (unfired) round from accidentally entering the firing chamber (although there may also be other mechanisms or components which also prevent more than one round from entering the firing chamber). Thus, when blocking plate 86 is in a firing position with a live round chambered in firing chamber 96, blocking plate 86 is in a position such that it is impossible for another round to be loaded into firing chamber 96. After firing of the round, blocking plate 86 is caused to move such that a new (live) round may be chambered into firing chamber 96.

In some embodiments, the ammunition is positioned/located in a co-axial relationship to the barrel such that when blocking plate 86 is in an "open" configuration (such as illustrated in, for example, FIG. 6B), a single round may be chambered into the barrel whereas when blocking plate is in other position (such as illustrated in FIG. 6A) ammunition is prevented from being chambered. Such an arrangement prevents more than one round from being chambered into a barrel at any time. Only after the round has been fired is a new round capable of being chambered into the respective barrel.

The act of loading and firing such an exemplary embodiment may be divided into a series of events and starting with an empty barrel (i.e., no round is chambered): (1) the blocking plate is positioned so as to not present an obstruction to the loading of a round, (2) a single round is loaded into the barrel, (3) the blocking plate is repositioned to prevent any additional rounds from being chambered, (4) the round is caused to fire by activation of a firing mechanism (any suitable firing mechanism may be utilized including, but not limited to, electronic ignition, mechanical, or any other means of igniting the propellant), (5) the blocking plate is positioned as in stage (1) such that it is in a position so that another round may be loaded.

In some embodiments, some portion of the exhaust gas created from the firing of the round may be captured in order to provide some or all of the force to move the blocking plate from one position/configuration to another (i.e., once the round is fired, some of the gas may be captured to move the blocking plate to the "open" configuration so that a new round may be chambered). Such force may be captured by allowing (or configuring the embodiment) to impact a piston which is then connected to the blocking plate. In some embodiments, there may be a two barrel configuration such that the blocking plate may be in at least two configurations, (1) one in which it is in an "open" configuration to a first barrel and in the "closed" position relative to the second barrel, and (2) a second position in which it is in the "closed" position relative to the first barrel and in the "open" configuration relative to the second barrel. In such a configuration, the captured exhaust gas may provide some (or all) of the force necessary to move the blocking plate between these two (and any intermediate) configurations.

Some embodiments have the ability to adjust, or set the number of rounds that are fired for each firing action. In some embodiments, a single "trigger pull" (note that trigger pull includes an action intended to initiate firing such as via electronic trigger, traditional trigger, or other means) may cause a single round to be fired. In some embodiments, two rounds may be fired for each "trigger pull". In some embodiments, the firearm may be fully automatic such that 2 or more rounds are fired for each "trigger pull". In some embodiments, the user may select the firing mode of the weapon wherein the firing mode is controlled/adjusted electronically. In some embodiments, and as discussed above, some embodiments with two or more barrels may fire one round for each barrel for each "trigger pull."

In some embodiments, additional ports or other venting means may be present to allow some of the exhaust gas created after the firing of the round to be vented from the firing chamber of the firearm.

In some embodiments, the frame and stock may be incorporated into a single unitary component.

Some embodiments may also include one or more sound recognition sensors, which may track and identify sounds within a predetermined vicinity of the firearm/weapon. Such capability may allow for recording of all rounds fired with the firearm as well as other sounds in the area. Such information may be stored locally to the firearm, such as internally in a computer readable format, as well as be downloaded to an external computer or computer system (or an external storage media including, but not limited to, USB drives, thumb drives, flash drives, compact discs, digital video discs and external hard drives) such as may be useful for further study. Some of the information that the sensor may measure/record includes, but is not limited to, the decibel level of each sound impact, record the sound in a digital format, the time that the sound began, and the duration of the sound. Such information may be particularly useful in police and military work. Devices similar to Saximeter may be used in accordance with the present invention. In some embodiments, the sound recognition sensors may be incorporated with, or even unitary with, a data acquisition system.

Firearm systems of the present invention may comprise single barrel devices, double barrel, and three or more barrel devices.

Such devices may be handheld or mounted such as may be used, for example, on aircraft, land vehicles, and water vehicles and may be manually, semi-automatic or automatically firing (i.e., machine guns).

Suitable caseless ammunition may be of any caliber.

Various members of the exemplary embodiments of the present invention may be made of any suitable material including, but not limited to, metal, steel, sheet metal, stainless steel, plastic, wood, aluminum, metal, carbon fiber, ceramics, acrylics, acrylic glasses, glass, silicone, and rubber. Various members of the exemplary embodiments of the present invention may be made of any suitable dimensions and thicknesses.

In several of the figures, various magazines are illustrated. In some embodiments, the magazines contain a plurality of rounds, wherein each round is maintained in a relationship such that a tip portion of one bullet is in close proximity, or even touching, the tail end of the forward bullet (the first bullet obviously not having a bullet in front of it). In such an arrangement, the bullets each have a central axis and each of the bullets may have their respective central axis be co-axial. In other embodiments, the rounds may be stored in a stacked pattern, similar to other double stacked magazines commercially available. In yet other embodiments, other types of magazines and/or round restraining/loading systems may be utilized including, but not limited to, spiral magazines, tubular magazines, belt fed, and gravitational. In other embodiments, two or more magazines may be utilized with a matching number of barrels. In yet other embodiments, there may be more or less magazines in use as compared to the number of barrels, i.e., in one embodiment there may be two or more magazines for a single barrel.

Although various components of the present invention may be illustrated as being of a particular shape for convenience, such components may be of any suitable shape, configuration, orientation, etc. Further, any number of additional components may be added to a particular embodiment to accommodate a particular need.

As described in various embodiments herein, such a firearm may present several advantages over a conventional weapon, including, but not limited to, (1) reduced weight, (2) reduced volume of rounds, both prior to firing when a caseless round may have a smaller volumetric footprint than a conventional metal cased round, and after firing when the conventional round casing must be accommodated whereas there is no case to be accommodated for the caseless rounds, (3) reduced cost by utilizing caseless rounds as compared to conventional rounds, (4) a simpler firearm in that there is no need for extracting and ejecting spent round casings which could be cheaper to manufacture and may have better reliability (i.e., less jamming), (5) reduced recoil due to the lack of extraction and ejection of spent casings which may be associated with a higher firing rate and overall better accuracy, (6) reduced recoil, and therefore higher accuracy, (7) reduced "lock-time" if utilizing an electric firing mechanism which could lead to better accuracy, and (8) the ability to track fired rounds and other data and sounds related to the firearm and activities in the vicinity of the firearm which may be stored electronically and downloaded to other devices.

Some embodiments may have one or more data acquisition systems. In some embodiments, the data acquisition system(s) may record data relating to whom is firing the weapon (such information may be obtained through fingerprint capture/analysis, audible entry via voice (or other) commands, or input by any other suitable means including, but not limited to, entry via a touchscreen or key board. In some embodiments, the data acquisition system may store information regarding the status of the firearm such as data related to the performance of the of various firearm components including, but not limited to, the performance of the spring or other biasing means—such data may be useful in determining whether the biasing means needs to be adjusted or replaced, for example), the firing chamber, etc. In some embodiments, the data acquisition system may store information regarding the type, timing and number of shots fired. Some data acquisition systems may track the identity of users (such as for example, by user inputted data such as name, badge number or other identifying information, or by biometrics such as retina scan, finger or thumbprint, or other means.

Note that there may be possible advantages of sloping or cutting away part of the material of one or more components, i.e., to utilize less material, or to decrease the weight of the device. As one of ordinary skill in the art would recognize, some advantage can be gained in using less material, but some minimum of material must be maintained to provide sufficient structural integrity for the device to be useful and to be able to fire caseless ammunition.

While the specification has been described in detail with respect to specific embodiments thereof, it will be appreciated that those skilled in the art, upon attaining an understanding of the foregoing, may readily conceive of alterations to, variations of, and equivalents to these embodiments.

What is claimed is:

1. A firearm for firing caseless ammunition, said firearm comprising:

a stock which is capable of receiving one or more magazines of caseless ammunition rounds said magazine having a central axis, a frame connected to said stock, one or more barrels each barrel having a respective central axis and each of said barrels being connected to said frame, one firing chamber for each barrel in communication with respective barrel such that a round fired in said firing chamber propels a bullet portion of said round through the respective barrel, and one or more blocking plates wherein said one or more blocking plates each perform at least two functions, (1) it prevents more than one round of ammunition from being loaded into each respective firing chamber, and (2) at least one surface of said blocking plate is a surface of the firing chamber and wherein the blocking plate is movable in a plane orthogonal to each of said barrel central axes and one or more stopper plates which prevent more than one round from entering said firing chamber wherein said one or more stopper plates are biased to prevent more than one round from entering each of said firing chambers and the number of stopper plates is equal to the number of barrels and wherein said one or more stopper plates is movable in a plane orthogonal to said barrel central axes.

2. The firearm of claim 1, further comprising one or more sound sensors for recording sounds in a digital format in or near the firearm.

3. The firearm of claim 1, further comprising an electric firing system using bipolar electrode pins positioned in side walls of each of said one or more firing chambers.

4. The firearm of claim 1, further comprising a data acquisition system for tracking users, dates, and rounds fired.

5. The firearm of claim 4, further comprising means to download said data to a separate electronic device.

6. The firearm of claim 1, wherein movement of said blocking plate is linear only.

7. The firearm of claim 1, wherein the number of barrels is two or more.

8. A firearm for firing caseless ammunition, said firearm comprising:

a stock which is capable of receiving one or more magazines of caseless ammunition rounds said magazine having a central axis, a frame connected to said stock, one or more barrels each barrel having a respective central axis and each of said barrels being connected to said frame, one firing chamber for each barrel in communication with respective barrel such that a round fired in said firing chamber propels a bullet portion of said round through the respective barrel, and one or more blocking plates wherein said one or more blocking plates each perform at least two functions, (1) it prevents more than one round of ammunition from being loaded into each respective firing chamber, and (2) at least one surface of said blocking plate is a surface of the firing chamber and wherein the blocking plate is movable in a plane orthogonal to each of said barrel central axes, and one or more gas escape gaps within said one or more blocking plates to divert gas pressure to a gas piston.

9. A firearm for firing caseless ammunition, said firearm comprising:

a stock which is capable of receiving one or more magazines of caseless ammunition rounds said magazine having a central axis, a frame connected to said stock, one or more barrels each barrel having a respective central axis and each of said barrels being connected to said frame, one firing chamber for each barrel in communication with respective barrel such that a round fired in said firing chamber propels a bullet portion of said round through the respective barrel, and one or more blocking plates wherein said one or more blocking plates each perform at least two functions, (1) it prevents more than one round of ammunition from being loaded into each respective firing chamber, and (2) at least one surface of said blocking plate is a surface of the firing chamber and wherein the blocking plate is movable in a plane orthogonal to each of said barrel central axes, and one or more inline magazines wherein each of the rounds stored in said one or more inline magazines are each positioned coaxially with the respective barrel.

10. A firearm for firing caseless ammunition, said firearm comprising:

a stock which is capable of receiving one or more magazines of caseless ammunition rounds said magazine having a central axis, a frame connected to said stock, one or more barrels each barrel having a respective central axis and each of said barrels being connected to said frame, one firing chamber for each barrel in communication with respective barrel such that a round fired in said firing chamber propels a bullet portion of said round through the respective barrel, and one or more blocking plates wherein said one or more blocking plates each perform at least two functions, (1) it prevents more than one round of ammunition from being loaded into each respective firing chamber, and (2) at least one surface of said blocking plate is a surface of the firing chamber and wherein the blocking plate is movable in a plane orthogonal to each of said barrel central axes, and wherein at least one unfired round is stored coaxially with the respective axis of the barrel while an additional unfired round is in said firing chamber.

11. A firearm for firing caseless ammunition, said firearm comprising:

a stock which is capable of receiving one or more magazines of caseless ammunition rounds said magazine having a central axis, a frame connected to said stock, one or more barrels each barrel having a respective central axis and each of said barrels being connected to said frame, one firing chamber for each barrel in communication with respective barrel such that a round fired in said firing chamber propels a bullet portion of said round through the respective barrel, and one or more blocking plates wherein said one or more blocking plates each perform at least two functions, (1) it prevents more than one round of ammunition from being loaded into each respective firing chamber, and (2) at least one surface of said blocking plate is a surface of the firing chamber and wherein the blocking plate is movable in a plane orthogonal to each of said barrel central axes, and two or more rounds in a magazine wherein the rounds are stored end to end and are positioned co-axial with a central axis of said respective barrel.

12. A firearm for firing caseless ammunition, said firearm comprising:

a stock which is capable of receiving one or more magazines of caseless ammunition rounds said magazine having a central axis, a frame connected to said stock, one or more barrels each barrel having a respective central axis and each of said barrels being connected to said frame, one firing chamber for each barrel in communication with respective barrel such that a round fired in said firing chamber propels a bullet portion of said round through the respective barrel, and one or more blocking plates wherein said one or more blocking plates each perform at least two functions, (1) it prevents more than one round of ammunition from being loaded into each respective firing chamber, and (2) at least one surface of said blocking plate is a surface of the firing chamber and wherein the blocking plate is movable in a plane orthogonal to each of said barrel central axes, and wherein there is one blocking plate that moves between the respective firing chambers of two barrels and wherein there is only one firing chamber capable of being fired at a given time.

* * * * *